US008570255B2

(12) United States Patent
Takei et al.

(10) Patent No.: US 8,570,255 B2
(45) Date of Patent: Oct. 29, 2013

(54) PIXEL DRIVING DEVICE, LIGHT EMITTING DEVICE AND LIGHT EMITTING DEVICE DRIVING CONTROL METHOD

(75) Inventors: Manabu Takei, Sagamihara (JP); Jun Ogura, Fussa (JP); Shunji Kashiyama, Sagamihara (JP); Tsuyoshi Ozaki, Fuchu (JP)

(73) Assignee: Casio Computer Co., Ltd., Tokyo (JP)

( * ) Notice: Subject to any disclaimer, the term of this patent is extended or adjusted under 35 U.S.C. 154(b) by 728 days.

(21) Appl. No.: 12/749,975

(22) Filed: Mar. 30, 2010

(65) Prior Publication Data

US 2010/0245343 A1 Sep. 30, 2010

(30) Foreign Application Priority Data

Mar. 31, 2009 (JP) ..... 2009-087471

(51) Int. Cl.
*G09G 3/30* (2006.01)

(52) U.S. Cl.
USPC ..... 345/77; 345/83

(58) Field of Classification Search
USPC ..... 345/36, 39, 45, 46, 76–83; 315/169.3
See application file for complete search history.

(56) References Cited

U.S. PATENT DOCUMENTS

| | | | | |
|---|---|---|---|---|
| 6,734,636 | B2 | 5/2004 | Sanford et al. | |
| 2004/0239596 | A1 * | 12/2004 | Ono et al. | 345/76 |
| 2008/0238953 | A1 * | 10/2008 | Ogura | 345/697 |

FOREIGN PATENT DOCUMENTS

| | | | |
|---|---|---|---|
| JP | 2003-271095 | A | 9/2003 |
| JP | 2004-004673 | A | 1/2004 |
| JP | 2006-301250 | A | 11/2006 |
| JP | 2007-322133 | A | 12/2007 |
| JP | 2008-250006 | | 10/2008 |

OTHER PUBLICATIONS

Japanese Office Action dated Jul. 5, 2011 (and English translation thereof) in counterpart Japanese Application No. 2009-087471.
Chinese Office Action dated Apr. 19, 2012 (and English translation thereof) in counterpart Chinese Application No. 201010158636.0.

* cited by examiner

*Primary Examiner* — Chanh Nguyen
*Assistant Examiner* — Sanghyuk Park
(74) *Attorney, Agent, or Firm* — Holtz, Holtz Goodman & Chick, PC

(57) ABSTRACT

A pixel includes a light emitting element and a driving element connected to the light emitting element. After an initial voltage is applied to one end of a current path of the driving element via the signal line, the pixel driving device acquires the threshold voltage of the driving element based on a voltage value at a terminal of the signal line when the initial voltage is cut off and the relaxation time is elapsed. The voltage-current characteristics of the driving element is acquired based on the voltage value at the terminal of the signal line when the current flows into the current path of the driving element via the signal line. The current gain value of the driving element is acquired based on the threshold voltage of the driving element. The image data is corrected based on the acquired threshold voltage.

19 Claims, 15 Drawing Sheets

Vl_0: Vth=Vth0 (INITIAL VALUE), β=β0 (STANDARD VALUE)

Vl_1: Vth=Vth0+ΔVth, β=β0

Vl_2: Vth=Vth0, β=β0+Δβ

Vl_3: Vth=Vth0, β=β0−Δβ t10
D/A CONVERTER CIRCUIT
163
Vprimary
T11(1)
Cg1(High)
171(1)
Vss
T12(1)
Cg2(Low)
Cg3(Low)
A/D CONVERTER CIRCUIT
131
T13(1)
Lv(1)
0V
11(1, 1)
T1
T2
T3
C1
111
0V
Ld(1)
Ls(1)
High t11
D/A CONVERTER CIRCUIT
163
T11(1)
Cg1(Low)
171(1)
Vss
T12(1)
Cg2(Low)
Cg3(Low)
A/D CONVERTER CIRCUIT
131
Vd(1)
T13(1)
Lv(1)
0V
11(1, 1)
T1
T2
T3
C1
111
0V
Ld(1)
Ls(1)

t13
D/A CONVERTER CIRCUIT
163
T11(1)
Cg1(Low)
171(1)
Vss
T12(1)
Cg2(Low)
Cg3(High)
A/D CONVERTER CIRCUIT
131
Vd(1)=Vth
T13(1)
Lv(1)
0V
11(1, 1)
T1
T2
T3
C1
111
0V
Ld(1)
Ls(1)
Low t21 t20 t21b t20b

PIXEL DRIVING DEVICE, LIGHT EMITTING DEVICE AND LIGHT EMITTING DEVICE DRIVING CONTROL METHOD

CROSS-REFERENCE TO RELATED APPLICATION

This application claims the benefit of Japanese Patent Application No. 2009-087471 filed Mar. 31, 2009, the entire disclosure of which is incorporated herein by reference.

FIELD

This invention relates to a pixel driving device, a light emitting device and a light emitting device driving control method.

BACKGROUND

An Organic Electro-Luminescence Element (an Organic EL Element) is formed by an organic compound of fluorescence to be emitted through the addition of the electric field. A display device including a display panel having Organic Light emitting Diode (hereinafter referred to as an OLED) elements in each pixel is attracting attention as a next-generation display device.

This OLED is a current driving element and emits luminance in proportion to the flow of the current. The display device equipped with such OLED has drive transistors that are configured by the field-effect transistors (thin-film transistors) in each pixel, and controls current values of the current supplied to the OLED according to the voltage applied to the gates.

A capacitor is connected between the gate and the source in the drive transistor in each pixel, while the voltage corresponding to a video signal supplied from an external source is written into this capacitor in order to retain the voltage.

After the voltage is applied between the drain and the source, the drive transistor supplies the current to the OLED while controlling the current value at this gate voltage Vgs as the voltage Vgs (hereinafter referred to as a "gate voltage") between the gate and the source.

The current value of the current to be supplied from the drive transistor to the OLED is determined according to the gate voltage Vgs value and the characteristics values of the applicable drive transistor (the threshold voltage Vth and the current gain β). The threshold voltage Vth is known to vary according to the past drive records in the pixel. When the variation in threshold voltage Vth occurs, the luminance of the OLED varies even if the gate voltage Vgs is the same, and consequently the quality of display image may be degraded.

Therefore, for the display device having light emitting elements such as the OLED in a pixel, the threshold voltage value Vth in each pixel is acquired, and the voltage value at the voltage to be applied between the gate and the source in the drive transistor is corrected according to the video signals based on the acquired threshold voltage value Vth. Therefore the development of the display device is pursued in order to improve quality display images.

However, as for an example of the current gain β, variations among the pixels may occur due to manufacturing processes. If the current gain β varies among the pixels, and even if the voltage value at the voltage to be applied between the gate and the source in the drive transistor is corrected after the threshold voltage Vth in each pixel is acquired, the degradation in display image quality caused by the variation of the current gain β among the pixels is not resolved.

SUMMARY

This invention advantageously provides a pixel driving device, a light emitting device and a light emitting device driving control method capable of controlling the degradation of the display image quality caused by the variations of the threshold voltage value in each pixel and the variation of the current gain in each pixel.

In order to obtain the advantage, the pixel driving device for driving pixels of the present application is a pixel driving device for driving pixels in accordance with image data, wherein the pixel includes a light emitting element, a driving element and a capacitor, wherein the driving element has a control terminal and one end of a current path connected to one terminal of the light emitting element and electrically connected to a signal line, and the capacitor is connected between the control terminal of the driving element and the one end of the current path of the driving element, the pixel driving device comprising: a first measuring circuit which acquires a threshold voltage of the driving element, on the basis of a voltage value at the terminal of the signal line, a voltage value being acquired after an initial voltage having a voltage value that exceeds the threshold voltage of the driving element is applied to the terminal of the signal line and a predetermined relaxation time is elapsed after the initial voltage to the signal line is cut off; a second measuring circuit which acquires a voltage-current characteristics of the driving element and acquires a current gain value of the driving element by the acquired voltage-current characteristics of the driving element and the threshold voltage of the driving element acquired by the first measurement circuit; and a correction processing circuit which corrects the image data to be supplied from an external source on the basis of the threshold voltage and the current gain of the driving element acquired by the first measuring circuit and the second measuring circuit.

In order to obtain the advantage, the light emitting device for emitting light in accordance with image data of the present application is a light emitting device for emitting light in accordance with image data, comprising: a pixel array including a plurality of pixels and a plurality of signal lines, wherein each pixel includes a light-emitting element, a driving element and a capacitor, wherein the driving element has one end of a current path connected to one terminal of the light-emitting element, and electrically connected to each signal line, and the capacitor is connected between a control terminal of the driving element and the one end of the current path of the driving element; a first measuring circuit which acquires a threshold voltage of the driving element of each pixel, on the basis of a voltage value at the terminal of each signal line, wherein the voltage value is acquired after an initial voltage having a voltage that exceeds the threshold voltage of the driving element is applied to the terminal of each signal line and a predetermined relaxation time is elapsed after the initial voltage to each signal line is cut off; a second measuring circuit which acquires a voltage-current characteristics of the driving element of each pixel and acquires a current gain value of the driving element of each pixel by the acquired voltage-current characteristics of the driving element of each pixel and the threshold voltage of the driving element acquired by the first measurement circuit; and a correction processing circuit which corrects the image data to be supplied from an external source on the basis of the threshold voltage and the current gain of the driving element of each pixel acquired from the first measuring circuit and the second measuring circuit.

In order to obtain the advantage, the light emitting device driving control method for emitting light device control method of the present application is a light emitting device driving control method for emitting light in accordance with image data, wherein the light emitting device includes a pixel array having a plurality of pixels and a plurality of signal lines, wherein each pixel includes a light-emitting element, a driving element and a capacitor, wherein the driving element has one end of a current path connected to one terminal of the light-emitting element, and electrically connected to each signal line, and the capacitor is connected between a control terminal of the driving element and the one end of the current path of the driving element, the light emitting device driving control method comprising: an initial voltage applying step that applies an initial voltage having a voltage that exceeds the threshold voltage of the driving element to a terminal of each signal line; a threshold voltage acquiring step that acquires a voltage value at the terminal of each signal line when a predetermined relaxation time is elapsed after the initial voltage to each signal line is cut off as the threshold voltage of the driving element of each pixel; a voltage-current characteristics acquiring step that acquires a voltage-current characteristics of the driving element of each pixel; a current gain acquiring step that acquires a current gain value of the driving element of each pixel on the basis of the voltage-current characteristics acquired in the voltage-current characteristics acquiring step and the threshold voltage of the driving element acquired in the threshold voltage acquiring step; and a correction step that corrects the image data to be supplied from an external source on the basis of the acquired threshold voltage and the acquired current gain of the driving element of each pixel.

BRIEF DESCRIPTION OF THE DRAWINGS

A more complete understanding of this application can be acquired when the following detailed description is considered in conjunction with the following drawings, in which.

DETAILED DESCRIPTION

Figure 1:
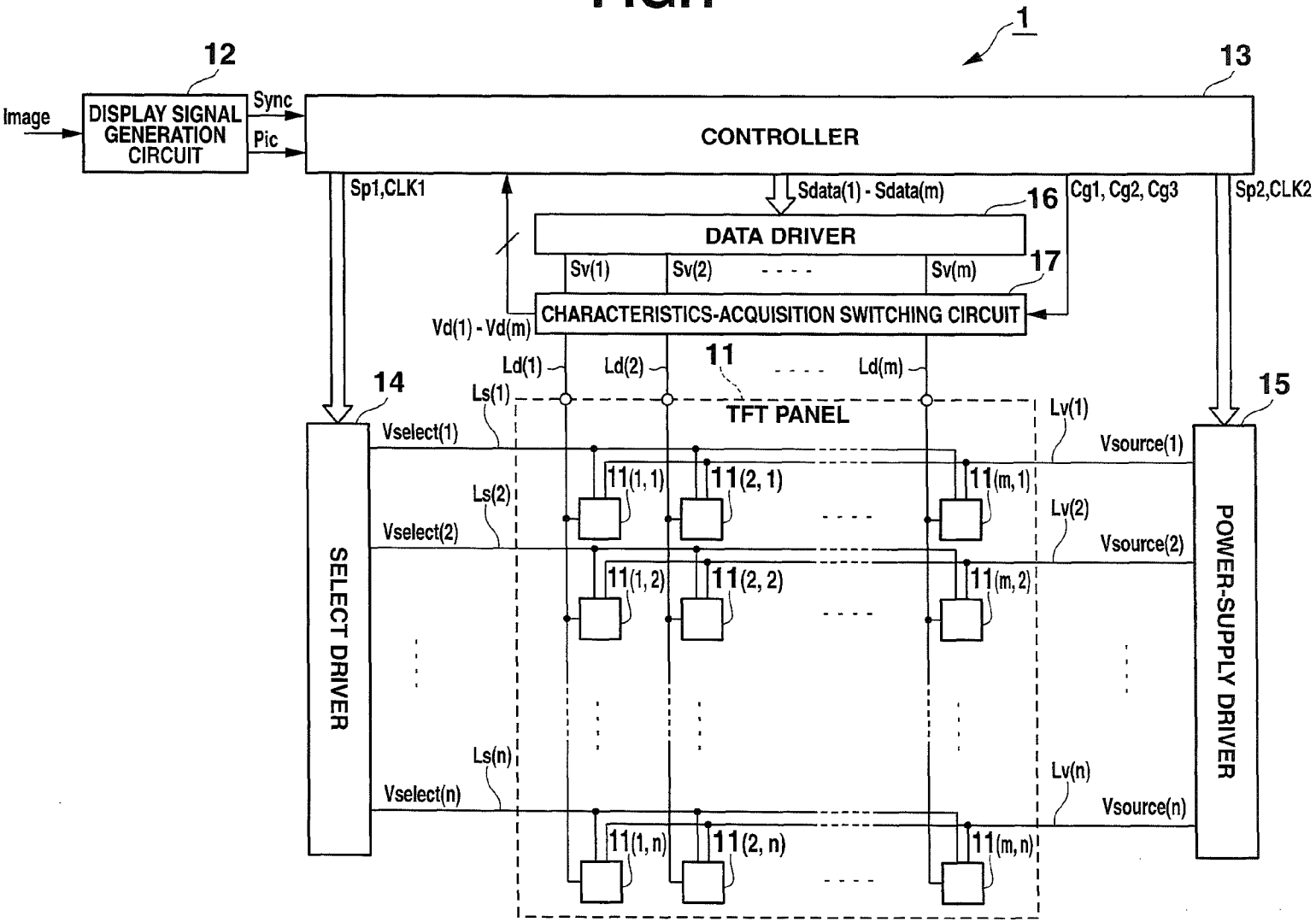
FIG. 1 is a block diagram showing a structure of a display device according to an embodiment of this invention.

The following describes a light emitting device according to an embodiment of this invention with reference to the drawings. Note that the following describes the light emitting device as a display device in this embodiment. FIG. 1 shows a structure of a display device according to this embodiment. The display device 1 (the light emitting device) according to this embodiment includes an OEL panel 11 (a pixel array), a display signal generation circuit 12, a controller 13, a select driver 14, a power-supply driver 15, a data driver 16 and a characteristics-acquiring switching circuit 17.

The OEL panel 11 includes multiple pixel circuits 11(i, j) (i=1 to m, j=1 to n, m and n; natural numbers).

Figure 2:
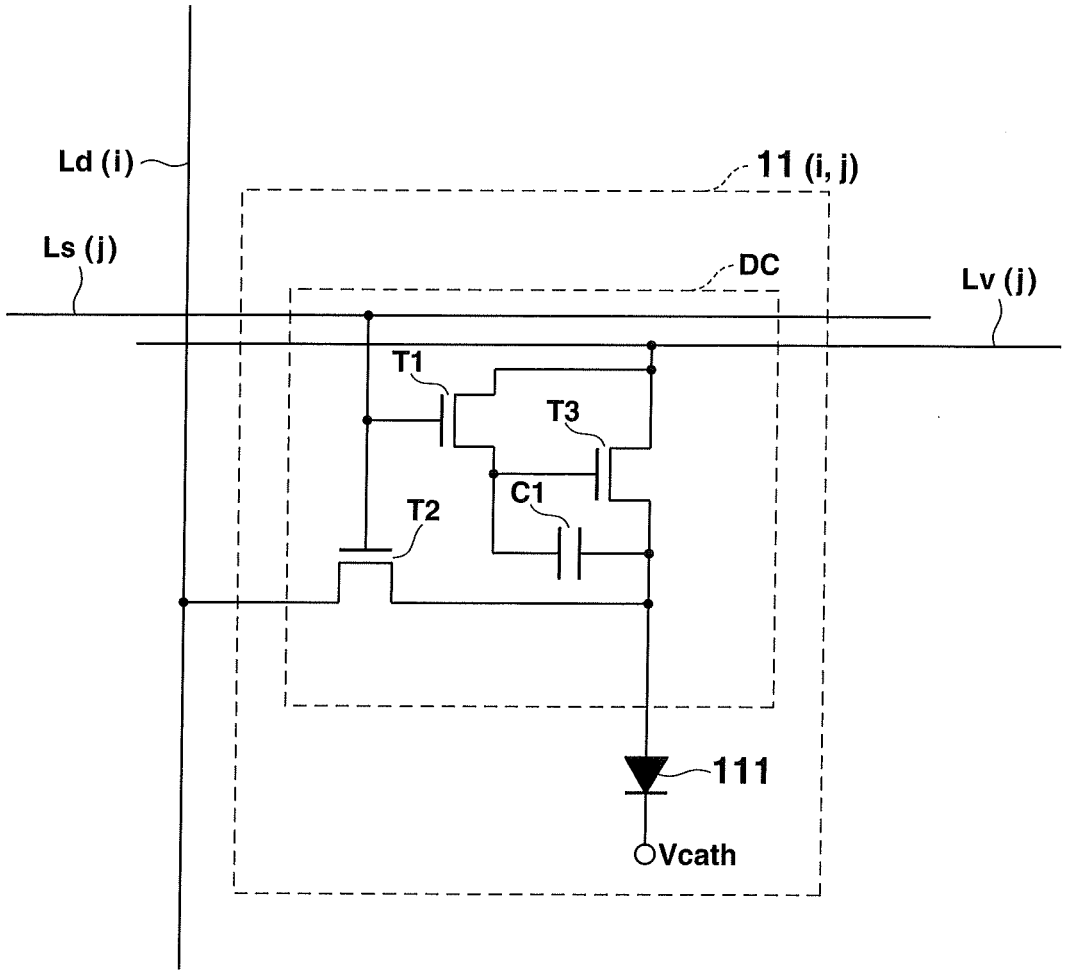
FIG. 2 is a diagram showing a structure of a pixel circuit shown in FIG. 1.

Each pixel circuit 11(i, j) is a display pixel that corresponds to one pixel of an image, and is placed in a matrix form. Each pixel circuit 11(i, j) includes a pixel circuit that has a circuit structure shown in FIG. 2. A pixel circuit has an OLED 111 (which are light emitting elements), transistors T1, T2 and T3, and a capacitor C1 (for retaining volume). The transistors T1, T2 and T3, together with the capacitor C1 form a pixel driving circuit DC.

The OLED 111 is a current control-type light emitting element (a display element) used to emit light by means of the exciter generated through the recombination of an electron and an electron hole, which are injected into the organic compound, and emits light with luminance corresponding to the value of the current thus supplied.

The OLED 111 has a pixel electrode and a pole electrode. The current flows from the pixel electrode in the direction into the pole electrode. The pixel electrode and the pole electrode become the anode electrode and the cathode electrode, respectively, and the cathode voltage Vcath is applied in this cathode electrode. The cathode voltage Vcath is set to 0 V in this embodiment.

The transistors T1, T2 and T3 in the pixel driving circuit DC are TFTs (Thin-Film Transistors) configured by n channel-type FETs (Field Effect Transistors), and are formed by, for instance, amorphous silicon or a polysilicon TFT.

The transistor T3 is a drive transistor (a driving element) used to control the current value of the current that is supplied to the OLED 111. The source on the first terminal on a current path (between the drain and the source) in the transistor T3 is connected to the anode in the OLED 111, and the drain on the second terminal on the current path in the transistor T3 is connected to the voltage line Lv(j).

The transistor T3 supplies the current of the current value corresponding to the gate voltage Vgs as the control voltage.

The transistor T1 is a switch transistor used to connect or disconnect between the gate (a control terminal) and the drain of the transistor T3.

The drain (a terminal) on the first terminal on a current path (between the drain and the source) in the transistor T1 in each pixel circuit (i, j) is connected to the voltage line Lv(j) (the drain in the transistor T3), while the source (a terminal) on the second terminal on the current path in the transistor T1 is connected to the gate as the control terminal in the transistor T3.

The gate (a terminal) in the transistor T1 of the pixel circuits 11(1, 1) through 11(m, 1) is connected to the select line Ls(1). Similarly, the gates in transistor T1 of the pixel circuits 11(1, 2) through 11(m, 2) and the gates in transistor T1 of the pixel circuits 11(1, n) through 11(m, n) are connected to the select line Ls(2) and the select line Ls(n), respectively.

In the case of the pixel circuit 11(1,1), when the high-level select signal Vselect(1) is output from the select driver 14 to the select line Ls(1), the transistor T1 is turned on, and then the gate and the drain are connected in the transistor T3 to set the diode connection state.

When the low-level select signal Vselect(1) is output to the select line Ls(1), the transistor T1 is turned off.

The transistor T2 is turned on/off by the select driver 14. The transistor T2 is a switch transistor used to connect or disconnect among the source in the transistor T3 and the anode in the OLED 111, and the data driver 16 via the data line Ld(i).

The drain on the second terminal on a current path (between the drain and the source) in the transistor T2 in each pixel circuit 11(i, j) is connected to the anode (an electrode) in the OLED 111.

The gates in the transistor T2 of the pixel circuits 11(1, 1) through 11(m, 1) are connected to the select line Ls(1). Similarly, the gates in the transistor T2 of the pixel circuits 11(2, 2) through 11(m, 2) are connected to the select line Ls(2), and the gates in the transistor T2 of the pixel circuits 11(1, n) through 11(m, n) are connected to the select line Ls(n).

Furthermore, the sources on the first terminal on the current path in the transistor T2 of the pixel circuits 11(1, 1) through 11(1, n) are connected to the data line Ld(1) as a signal line. Similarly, the sources in the transistor T2 of the pixel circuits 11(2, 1) through 11(2, n) are connected to the data line Ld(2), while the sources in the transistor T2 of the pixel circuits 11(m, 1) through 11(m, n) are connected to the data line Ld(m).

In the case of the pixel circuit 11(1,1), when the high-level select signal Vselect(1) is output from the select driver 14 to the select line Ls(1), the transistor T2 is turned on to connect the anode in the OLED 111 and the data line Ld(1).

When the low-level select signal Vselect(1) is output to the select line Ls(1), the transistor T2 is turned off to disconnect the anode in the OLED 111 and the data line Ld(1).

The capacitor C1 is connected between the gate in the transistor T3 and the source, and is a capacity component used to retain the gate voltage Vgs. One terminal in the capacitor C1 is connected to the source in the transistor T1 and the gate in the transistor T3, while the other terminal is connected to the source in the transistor T3 and the anode in the OLED 111.

When the drain current Id flows from the voltage line Lv(j) toward the drain in the transistor T2, the transistor T3 is turned on, and the capacitor C1 is charged with the gate voltage Vgs of the transistor T3 to which the charge is accumulated.

When the transistors T1 and T2 are turned off, the capacitor C1 retains the gate voltage Vgs of the transistor T3.

For example, a video signal Image, such as a composite video signal or a component video signal, is supplied from the external source in FIG. 1. The display signal generation circuit 12 acquires an image data Pic from a luminance signal and a synchronous signal Sync from the supplied video signal Image. The display signal generation circuit 12 then supplies the acquired image data Pic and the synchronous signal Sync to the controller 13.

The controller 13 supplies the control signals, and the like to each section, and controls the write processing and the light emitting operation for the OLED 111.

The write processing is used to write the voltage corresponding to a gradation value of the image data Pic to the capacitor C1 in each pixel circuit 11(i, j), whereas the light emitting operation is used to make the OLED 111 emit light.

The following describes the general display characteristics during the image display operation. If the visual characteristics of a person are considered, based on the characteristic that the luminance L of the display is in direct proportion to the input signal intensity Sig, the luminance L tends to darken as the input signal intensity Sig weakens.

Thus, it is desirable to set the display characteristic to the characteristic ($\gamma>1$) shown in the following Formula 1:

$$L=\mathrm{Sig}^{\gamma} \tag{1}$$

The characteristic shown in Formula 1 is collectively called the Gamma characteristic of display in which $\gamma$ called the Gamma value, is set to 2, for example.

If the display device 1 using this OLED 111 has the Gamma characteristic ($\gamma=2$), the voltage value corresponding to the gradation value of the image data Pic will be represented as Vcode, and the input signal intensity Sig is shown in Formula 2. In this case, $\beta m$ is a gain as a proportional coefficient.

$$\mathrm{Sig}=\sqrt{\beta m}\times V\mathrm{code} \tag{2}$$

The luminance L of the display corresponds to the light emitting luminance of the OLED 111. Also, the light emitting luminance of the OLED 111 is proportional to the current value Iel of the current that flows into the OLED 111. Therefore, when the relationship between the input signal intensity Sig and the voltage Vcode corresponding to the gradation value of the image data Pic is represented in Formula 2, it is necessary to represent the relationship between the current value Iel of the current that flows into the OLED 111 and the voltage value Vcode in Formula 3 below:

$$Iel=\beta m\times V\mathrm{code}^2 \tag{3}$$

Meanwhile, the current that flows into the OLED 111 during the light emitting operation for each pixel 11(i, j) in this embodiment is nearly equivalent to the drain current Id that flows into the transistor T3 during the write operation. The drain current Id and the voltage Vdata to be applied to the data line Ld(i) have the relationship shown in Formula 4 below:

$$Id=\beta\times(V\mathrm{data}-Vth^2) \tag{4}$$

Accordingly, because the drain current Id in Formula 4 and the current Iel that flows into the OLED 111 shown in Formula 3 are equivalent, the relationship between the voltage Vdata to be applied to the data line Ld(i) and the voltage value Vcode that corresponds to the gradation value of the image data Pic is represented by Formula 5 below:

[Formula 5]

$$Vdata = Vcode\times\frac{\sqrt{\beta m}}{\beta}+Vth \tag{5}$$

Therefore, if the voltage value Vcode that corresponds to the gradation value of the image data Pic to be supplied from the display signal generation circuit 12 is corrected according to Formula 5 above, the luminance that corresponds to the image data Pic may be acquired, and the display characteristic shown in Formula 1 may be acquired.

Figure 3:
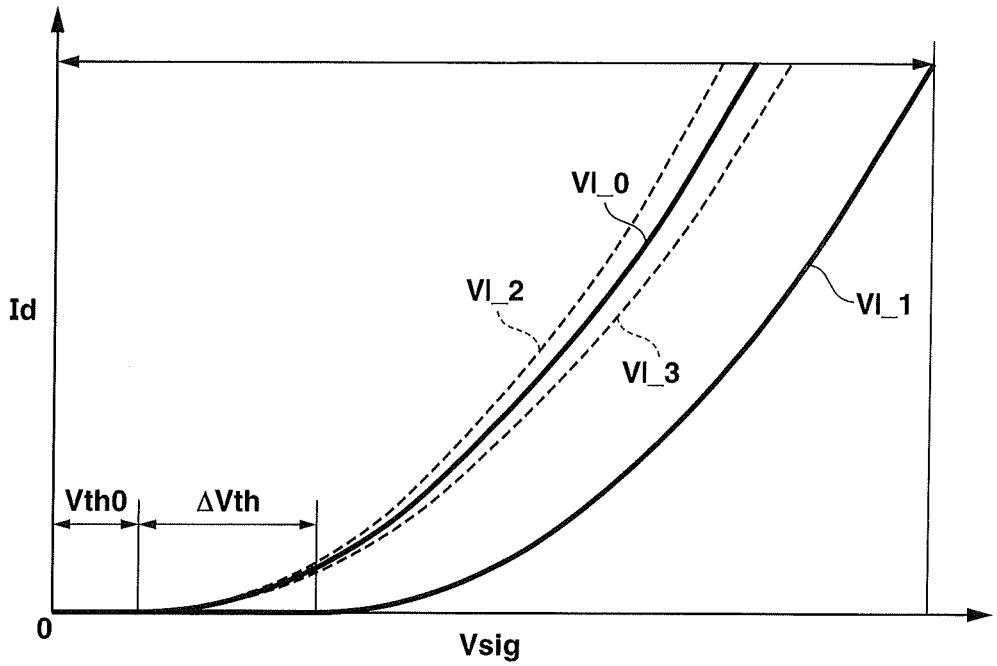
FIG. 3 is a diagram showing current-voltage characteristics of a drive transistor shown in FIG. 2.

However, the transistor T3 is degraded over time due to the flow of drain current Id shown in FIG. 3 and the threshold voltage Vth shown in Formula 5 is gradually shifted (increased) due to an over-time degradation of the transistor T3.

Note that the current-voltage characteristics VI_0 in the drawing denotes the current-voltage characteristics of the transistor T3 if the threshold voltage Vth is an initial value at the factory setting at the time of shipment and the β value is a standard value.

As shown in FIG. 3, if the threshold voltage Vth shifts only ΔVth, the current-voltage characteristics VI_0 of the transistor T3 changes to the characteristics VI_1.

Additionally, β (as shown in Formula 5) shows the variation in each pixel circuit 11(i, j) caused by factors inherent to the manufacturing process. For example, when β0 is set to the standard value of β (e.g., a design value or a typical value) and β=(β0+Δβ), the drain current-gate voltage (which is equivalent to the drain voltage) characteristics VI_0 of the transistor T3 are set to the drain current-gate voltage characteristics VI_2. Moreover, when β=(β0−Δβ), the current-voltage characteristics VI_0 of the transistor T3 are set to the current-voltage characteristics VI_3.

The variations of this threshold voltage Vth and the variations of β may affect the image quality (display characteristic) of the display device 1. Therefore, in order to improve the display image quality, the threshold voltage Vth and β is acquired, whereupon the image data Pic is corrected based on the acquired threshold voltage Vth and β.

In this embodiment, an auto-zero method is used to acquire the threshold voltage Vth for each pixel circuit 11(i, j). Then, the relation of the drain current Id and the drain voltage in the transistor T3 are acquired according to a current supply-voltage measurement method, and the β value is acquired based on the threshold voltage Vth acquired through the auto-zero method.

Figure 4A:
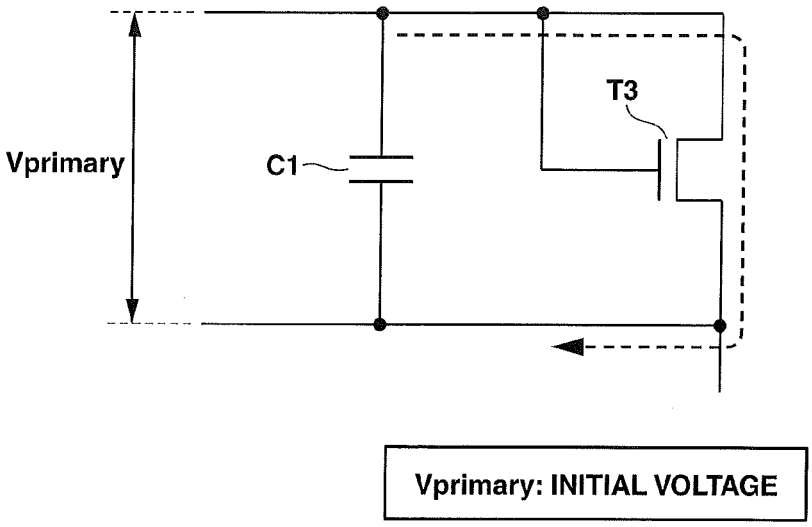
FIGS. 4A and 4B are diagrams describing an auto-zero method.
Figure 4B:
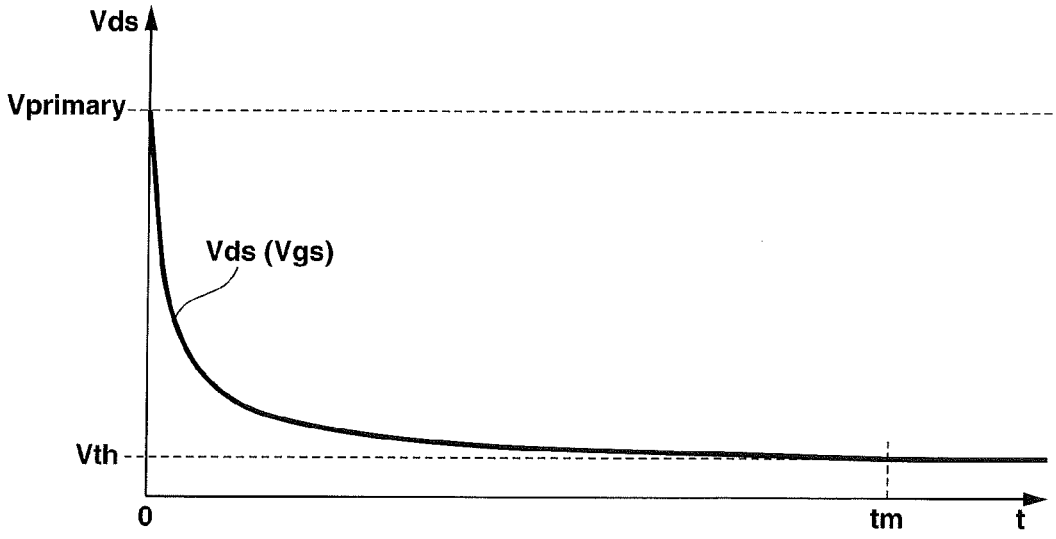

The following describes the auto-zero method:

FIGS. 4A and 4B are used to describe the auto-zero method. Note that if the pixel circuit 11(i, j) is set to a pixel circuit of the circuit structure shown in FIG. 2, the select driver 14 outputs the high-level select signal Vselect(j) to the select line Ls (j) when the pixel circuit 11(i, j) is selected.

As shown in FIG. 4A, using the auto-zero method, an initial voltage Vprimary that exceeds the threshold voltage Vth is applied between the drain and the source (gate-source) in the transistor T3 of the selected pixel circuit 11(i, j) in order to set the transistor T3 to the "on" state. The transistor T3 is then set to the high-impedance state.

When the transistor T3 is set to the high-impedance state, the current is not flowed from the transistor T3 to the external source. However, the transistor T3 retains the "on" state due to the electrical charge accumulated in the capacitor C1, and the drain current Id continues to flow between the drain and the source in the transistor T3 based on the electrical charge accumulated in the capacitor C1. Consequently, when the transistor T3 is set to the high-impedance state, the electrical charge corresponding to the initial voltage Vprimary that is previously accumulated in the capacitor C1 is gradually discharged. As shown in FIG. 4B, the drain voltage Vds (gate voltage Vgs) in the transistor T3 is gradually degraded (a process called natural relaxation) from the value of the initial voltage Vprimary.

The auto-zero method is used to measure the drain voltage Vds (gate voltage Vgs) as the threshold voltage Vth at the point after the high-impedance state is set and relaxation time tm to be set to the time when the drain current Id is not flowing has elapsed, as shown in FIG. 4B. The electrical charge corresponding to the initial voltage Vprimary is partially discharged, and the electrical charge accumulated in the capacitor C1 becomes the state converged to a constant charge capacity corresponding to the threshold voltage Vth.

In this case, if time t is defined as the elapsed time after the high-impedance state is set, a potential difference Vds(t) for the drain voltage Vds is represented by Formula 6 below:

[Formula 6]

$$Vds(t) = Vth + \frac{Vprimary - Vth}{\frac{(Vprimary - Vth) \times \beta \times t}{Cp} + 1} \tag{6}$$

Note that Cp in Formula 6 denotes the capacity value in the capacitor C1. In Formula 6, if t=∞, the drain voltage Vds(∞) becomes the threshold voltage Vth. Namely, the drain voltage Vds(t) becomes asymptotic with respect to the threshold voltage Vth over time. However, in theory, even if the over-time t is set to "infinite," the drain voltage Vds(t) does not coincide with the threshold voltage Vth. Nevertheless, as shown in FIG. 4B, by setting the relaxation time tm to a time nearly equivalent to the threshold voltage Vth, the drain voltage at tm Vds(tm) is mostly equivalent to the threshold voltage Vth. Consequently, the threshold voltage Vth can be measured using the auto-zero method.

The characteristics-acquiring switching circuit 17 is used to output the voltages Vd(1) through Vd(m) of data lines Ld(1) through Ld(m) for each line to the control 13. When the threshold voltage Vth is measured using the auto-zero method, the voltages Vd(1) through Vd(m) to be output from the characteristics-acquiring switching circuit 17 become the threshold voltages Vth in each transistor T3 for the jth-line pixel circuits 11(1, j) through 11(m, j).

Figure 5:
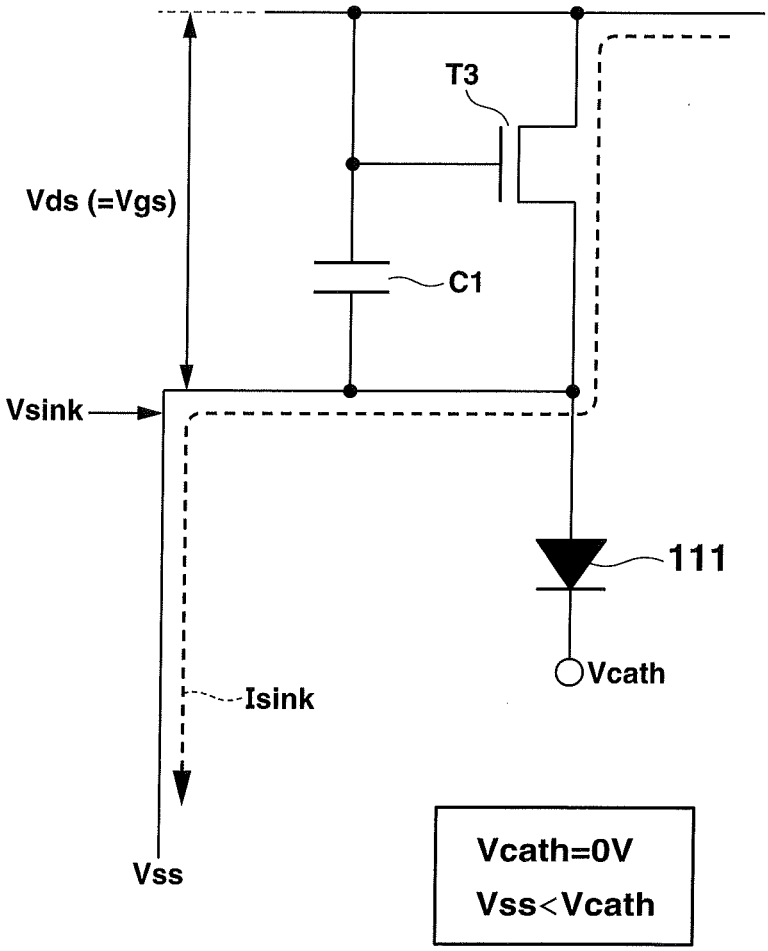
FIG. 5 is a diagram describing a current supply-voltage measurement method.

The following describes the current supply-voltage measurement method. FIG. 5 shows the current supply-voltage measurement method. As shown in FIG. 5, the current supply-voltage measurement method in this embodiment is used to measure a voltage Vsink of the data line Ld(i) when the current Isink flows into the drawing-in direction via the data line Ld(i) between the drain and the source in the transistor T3 for the selected pixel circuit 11(i, j). This voltage Vsink becomes the voltage between the drain and the source in the transistor T3 if the wiring resistance is ignored by setting the drain voltage in the transistor T3 to 0 V.

Moreover, β is represented by the following Formula 7. If the threshold voltage Vth value is already known, the β value can be acquired from Formula 7 below:

[Formula 7]

$$\beta = \frac{Isink}{(Vsink - Vth)^2} \tag{7}$$

Note that the β value does not normally change over time. Thus, for example, at the time of shipment from the factory prior to actual use or when the power of the display device 1 is initially turned on after shipment of the product, and once the β value is acquired, it is not necessary to acquire the β value again. However, the β value measurement may be performed again using an arbitrary timing upon the actual use as necessary.

On the other hand, since the threshold voltage Vth changes over time, it is necessary to measure the threshold voltage Vth at startup during the actual use of the display device 1 or each time the image is displayed, or at periodic intervals.

Figure 6:
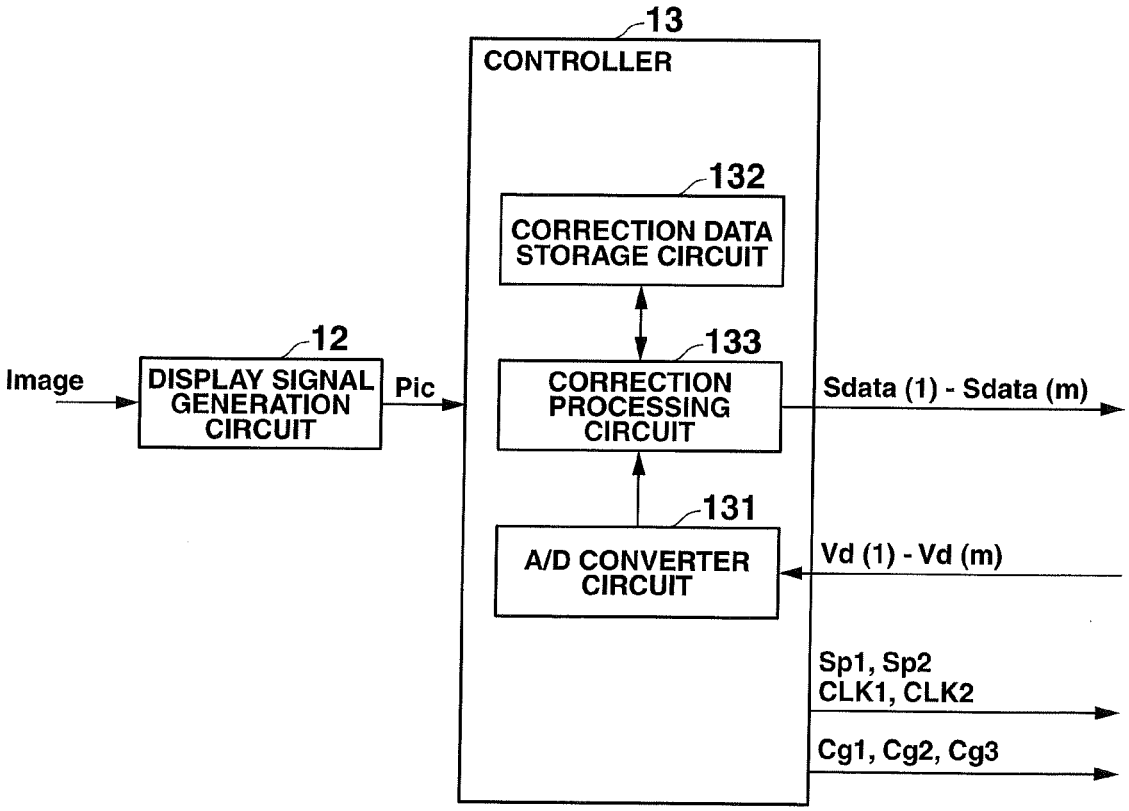
FIG. 6 is a diagram showing a structure of a controller shown in FIG. 1.

The controller 13 is used to correct the image data Pic using the threshold voltage Vth and the β value acquired from the above, and, as shown in FIG. 6, the controller 13 includes an A/D converter circuit 131, a correction data storage circuit 132 and a correction processing circuit 133.

The A/D converter circuit 131 is used to convert the analog voltages Vd(1) through Vd(m) output from the characteristics-acquiring switching circuit 17 into digital voltages Vd(1) through Vd(m).

When the auto-zero method is used, the A/D converter circuit 131 acquires the voltages Vd(1) through Vd(m) output from the characteristics-acquiring switching circuit 17 as the threshold voltage Vth of each transistor T3 in the selected jth-line pixel circuits 11(i, j) through 11(m, j), and converts them into digital values.

When the current supply-voltage measurement method is used, the A/D converter circuit 131 acquires the voltages Vd(1) through Vd(m) output from the characteristics-acquiring switching circuit 17 as each voltage Vsink of the selected jth-line, and converts the voltages Vd(1) through Vd(m) into digital values.

The A/D converter circuit 131 supplies the threshold voltage Vth and the voltage Vsink, which have been converted into digital values, to the correction processing circuit 133. The correction processing circuit 133 stores the supplied threshold voltage Vth and the voltage Vsink into the correction data storage circuit 132. Note that the A/D converter circuit 131 in the controller 13 is arranged with the same number of the line count (m) in the OLED panel 11.

The correction data storage circuit 132 stores the image data Pic of each pixel 11(i, j) once the image data Pic is supplied from the display signal generation circuit 12, and stores the data related to correction of the voltage-current characteristics-related data of the transistor T3 in each pixel circuit 11(i, j) and the image data Pic.

The correction data storage circuit 132 includes a storage area used to store the image data Pic values, a storage area used to store the threshold voltage Vth values, a storage area used to store the β values and a storage area used to store the voltage Vsink values according to each pixel circuit 11(i, j). Additionally, the correction data storage circuit 132 stores the current values of the current Isink as the data related to the voltage-current characteristics of the transistor T3 for each pixel circuit 11(i, j).

The correction processing circuit 133 is used to perform a correction processing with the image data Pic. The correction processing circuit 133 reads the threshold voltages Vth and the voltages Vsink from the correction data storage circuit 132 for each line, and reads the current values in the current Isink.

Then, the correction processing circuit 133 computes the result according to Formula 7 using the threshold voltage Vth, the voltage Vsink and the current Isink. As a result, the β value for each pixel circuit 11(i, j) is acquired as data related to the voltage-current characteristics of the transistor T3. The correction processing circuit 133 stores the β value acquired for each pixel circuit 11(i, j) into the storage area corresponding to the correction data storage circuit 132.

The correction processing circuit 133 reads the image data Pic, the threshold voltage Vth of the transistor T3 in each pixel circuit 11(i, j) and the β value from the correction data storage circuit 132 for each line, and corrects the image data Pic.

The controller 13 outputs the image data Pic, which is corrected by the correction processing circuit 133 to the data driver 16 for each line as the correction gradation signals Sdata(1) through Sdata(m), which in turn correspond to the selected j-line pixel circuits 11(1, j) through 11(m, j).

Additionally, when the video signal Image is supplied from the external source, the controller 13 generates clock signals CLK1 and CLK2 that are synchronized to the synchronous signal Sync, as supplied from the display signal generation circuit 12, and various control signals such as the start signals Sp1 and Sp2 used to start up an operation.

Subsequently, the controller 13 supplies those generated control signals to the select driver 14, the power-supply driver 15 and the data driver 16.

As shown in FIG. 1, the select driver 14 is used to select the lines in the OLED panel 11 one by one, and includes the shift registers. The select driver 14 is connected to the gates of the transistors T1 and T2 in each pixel circuit 11(i, j) via each of the select lines Ls(j) (j=1 to n).

The select driver 14 synchronizes the start signal Sp1, which is synchronized to a vertical synchronous signal supplied as a vertical control signal from the controller 13. According to the clock signal CLK1, which is to be supplied from the controller 13 as the vertical control signal, the select driver 14 selects each line in the OLED panel 11 by sending the high-level select signal Vselect(j) to the pixel circuits 11(1, 1) through 11(m, 1) for the first line, . . . , pixel circuits 11(1, n) through 11(m, n) for the nth line, one by one.

The power-supply driver 15 is used to output the voltage VL or VH voltage signals Vsource(1) through Vsource(n) to the voltage lines Lv(1) through Lv(n) one by one, and is connected to the drain of the transistor T3 in each pixel circuit 11(i, j) via the voltage lines Lv(j) (j=1 to n).

The power-supply driver 15 receives the start signal Sp2 from the controller 13 and starts up an operation according to the clock signal CLK2 supplied from the controller 13.

The power-supply driver 15 then outputs the voltage VL or VH voltage signals Vsource(1) through Vsource(n). The voltage VL is used to set the OLED 111 in each pixel circuit 11(i, j) to the non-emitting state during the write operation and the like. In this embodiment, the cathode voltage Vcath in the OLED 111 is set to 0 V and the voltage VL is set to 0 V or a potential lower than 0 V.

The voltage VH is used to set the OLED 111 in each pixel circuit 11(i, j) to the emitting state. In this embodiment, the voltage VH is set, for example, to +15 V.

The data driver 16 outputs the voltage signal Sv(i), which contains the analog gradation voltage Vdata(i) to the data line Ld(i), and writes the gradation voltage Vdata(i) in the capacitor C1 that is connected between the gate and source in the transistor T3 for each pixel circuit 11(i, j).

Figure 7:
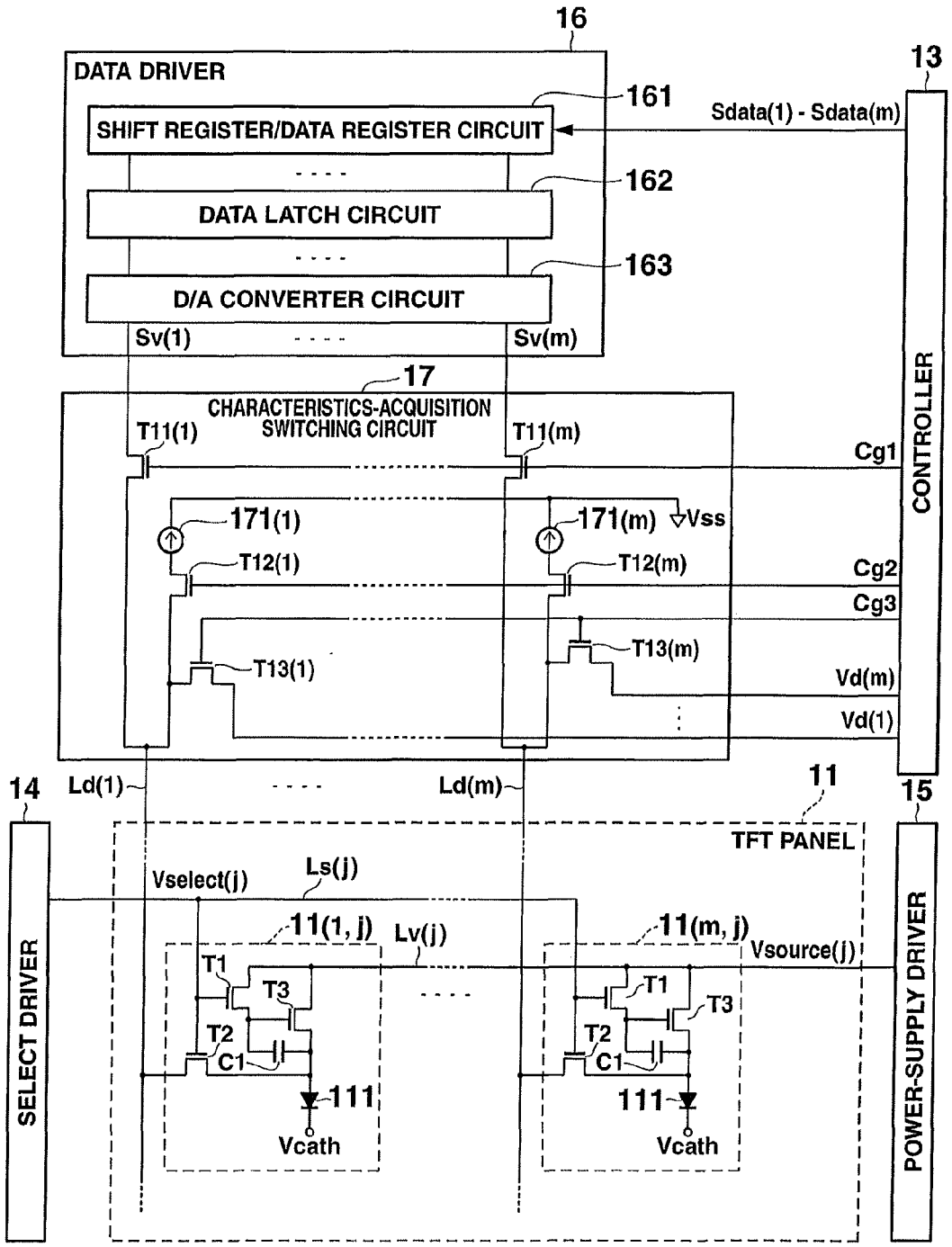
FIG. 7 is a diagram showing a structure of a data driver and a characteristics-acquiring switching circuit shown in FIG. 1.

As shown in FIG. 7, the data driver 16 includes a shift register/data register circuit 161, a data latch circuit 162 and a D/A converter circuit 163.

The shift register/data register circuit 161 is used to write the digital correction gradation signals Sdata(1) through Sdata(m) supplied from the controller 13 corresponding to the data lines Ld(1) through Ld(m) by shifting one by one. Subsequently, the shift register/data register circuit 161 supplies the provided correction gradation signals Sdata(1) through Sdata(m) to the data latch circuit 162.

The data latch circuit 162 is used to retain the correction gradation signals Sdata(1) through Sdata(m) supplied from the shift register/data register circuit 161, and then supplies the correction gradation signals Sdata(1) through Sdata(m) to the D/A converter circuit 163.

The D/A converter circuit 163 generates the voltage signals Sv(1) through Sv(m) that have the gradation voltages Vdata (1) through Vdata(m) which are converted from the digital correction gradation signals Sdata(1) to Sdata(m) to analog values. In this case, the gradation voltages Vdata(1) through Vdata(m) have negative polarity.

The D/A converter circuit 163 supplies the generated voltage signals Sv(1) through Sv(m) to the characteristics-acquiring switching circuit 17.

When the D/A converter circuit 163 is used to acquire the threshold voltage Vth for each pixel circuit 11(i, j) through the use of the auto-zero method, the D/A converter circuit 163 outputs the voltage signals of the initial voltage Vprimary (instead of the voltage signals Sv(1) through Sv(m)) to the characteristics-acquiring switching circuit 17. For instance, the voltage signals of the initial voltage Vprimary are set in the D/A converter circuit 163 in advance. Alternatively, by setting the correction gradation signals Sdata(1) through Sdata(m) to be supplied from the controller 13 to the shift register/data register circuit 161 to signals corresponding to the initial voltage Vprimary, the voltage signals of the initial voltage Vprimary may output from the D/A converter circuit 163. In any case, the D/A converter circuit 163 functions as the voltage-applied circuit in this invention.

The characteristics-acquiring switching circuit 17 is used to output the voltage signals Sv(1) through Sv(m) supplied from the data driver 16, signals of the initial voltage Vprimary or the current Isink onto the data lines Ld(1) through Ld(m). As shown in FIG. 7, the characteristics-acquiring switching circuit 17 includes the current sources 171(1) through 171(m), transistors T11(1) through T11(m), T12(1) through T12(m) and T13(1) through T13(m).

The current sources 171(1) through 171(m) are used to supply the current Isink for measurement. The current sources 171(1) through 171(m) supply the current Isink from the data lines Ld(1) through Ld(m) to the side of the data lines Ld(1) through Ld(m) via transistor T3 for each line in the drawing-in direction. The current values of the current Isink are either set to each current source 171(1) through 171(m) in advance or are set by the controller 13. Each current downstream terminal of the current sources 171(1) through 171(m) is set to the potential Vss.

The transistors T11(1) through T11(m), T12(1) through T12(m) and T13(1) through T13(m) are TFTs (Thin-Film Transistors) which are configured by the n-channel type FET.

The transistors T11(1) through T11(m) are turned on and off according to the control signal Cg1 to be supplied from the controller 13, and are used to connect or disconnect between the data driver 16 and the OEL panel 11. The source in the transistors T11(1) through T11(m) is connected to the D/A converter circuit 163 in the data driver 16.

The transistors T11(1) through T11(m) are turned on after a high-level control signal Cg1 (hereinafter referred to as the control signal Cg1(High)) is supplied from the controller 13 to the gate. When the transistors T11(1) through T11(m) are turned on, and the transistors T11(1) through T11(m) connect the D/A converter circuit 163 and the data lines Ld(1) through Ld(m).

The transistors T11(1) through T11(m) are turned off after a low-level control signal Cg1 (hereinafter referred to as the control signal Cg1(Low)) is supplied from the controller 13 to the gate. When the transistors T11(1) through T11(m) are turned off, the transistors T11(1) through T11(m) disconnect between the D/A converter circuit 163 and the data lines Ld(1) through Ld(m).

The transistors T12(1) through T12(m) are used to connect or disconnect between the current sources 171(1) through 171(m) and the data lines Ld(1) through Ld(m).

The drains in the transistors T12(1) through T12(m) are connected to the data lines Ld(1) through Ld(m) respectively, and the source is connected to the current upstream terminals of the current sources 171(1) through 171(m). Each gate is connected to the controller 13, and the control signal Cg2 is supplied from the controller 13.

The transistors T12(1) through T12(m) are turned on after a high-level control signal Cg2 (hereinafter referred to as the control signal Cg2(High)) is supplied from the controller 13 to the gate. When the transistors T12(1) through T12(m) are turned on, the transistors T12(1) through T12(m) connect between the current source 171(1) and the data line Ld(1), . . . , the current source 171(m) and the data line Ld(m), respectively.

The transistors T12(1) through T12(m) are turned off after a low-level control signal Cg2 (hereinafter referred to as the control signal Cg2(Low)) is supplied from the controller 13 to the gate. When the transistors T12(1) through T12(m) are turned off, the transistors T12(1) through T12(m) disconnect between the current source 171(1) and the data line Ld(1), . . . , the current source 171(m) and the data line Ld(m), respectively.

The transistors T13(1) through T13(m) are used to connect or disconnect between the current downstream terminals of the current sources 171(1) through 171(m) and the A/D converter circuit 131 in the controller 13.

The drains in the transistors T13(1) through T13(m) are connected to the current downstream terminals of the current sources 171(1) through 171(m) and the data lines Ld(1) through Ld(m), respectively, and the sources are connected to the A/D converter circuit 131 in the controller 13. The gates are connected to the controller 13, whereupon the control signal Cg3 is supplied from the controller 13. The m number of A/D converter circuits 131 in the controller 13 is installed corresponding to the transistors T13(1) through T13(m), and the converters are connected to the sources in the transistors T13(1) through T13(m).

The transistors T13(1) through T13(m) are turned on after a high-level control signal Cg3 (hereinafter referred to as the control signal Cg3(High)) is supplied. When the transistors T13(1) through T13(m) are turned on, the current downstream terminal of the current sources 171(1) through 171(m) and the data lines Ld(1) through Ld(m) are connected to the A/D converter circuit 131 in the controller 13. Consequently, the voltages Vd(1) through Vd(m) of the data lines Ld(1) through Ld(m) are applied to the A/D converter circuit 131 in the controller 13.

The transistors T13(1) through T13(m) are turned off after a low-level control signal Cg3 (hereinafter referred to as the control signal Cg3(Low)) is supplied. When the transistors T13(1) through T13(m) are turned off, the connections between the current downstream terminals of the current sources 171(1) through 171(m) and the A/D converter circuit 131 in the controller 13 are cut off.

The following describes the display device operation according to this embodiment. Note that the transistors T11, T12 and T13 are indicated as switches in FIGS. 9A, 9B and 9C.

The display device 1 is used to acquire the threshold voltage Vth in each transistor T3 in each pixel circuit 11(1, 1) through 11(m, 1), . . . , 11(1, n) through 11(m, n), and the β values at the time of factory shipment before the actual operation.

The following describes the operation to acquire the threshold voltage Vth. The controller 13 acquires the threshold voltage Vth of each transistor T3 in each pixel circuit 11(1, 1) through 11(m, 1), . . . , 11(1, n) through 11(m, n) using the auto-zero method.

Thus, the controller 13 supplies the start signals Sp1 and Sp2, the clock signals CLK1 and CLK2 to the select driver 14, the power-supply driver 15 and the data driver 16.

The select driver 14, the power-supply driver 15 and the data driver 16 start the operation after the start signals Sp1 and Sp2 are supplied from the controller 13, and operate according to the clock signals CLK1 and CLK2.

After the select driver 14 starts the operation, the select driver 14 outputs the high-level signals Vselect(1), Vselect (2), . . . Vselect(n) to the select lines Ls(1), Ls(2), . . . Ls(n), one by one.

Figure 8:
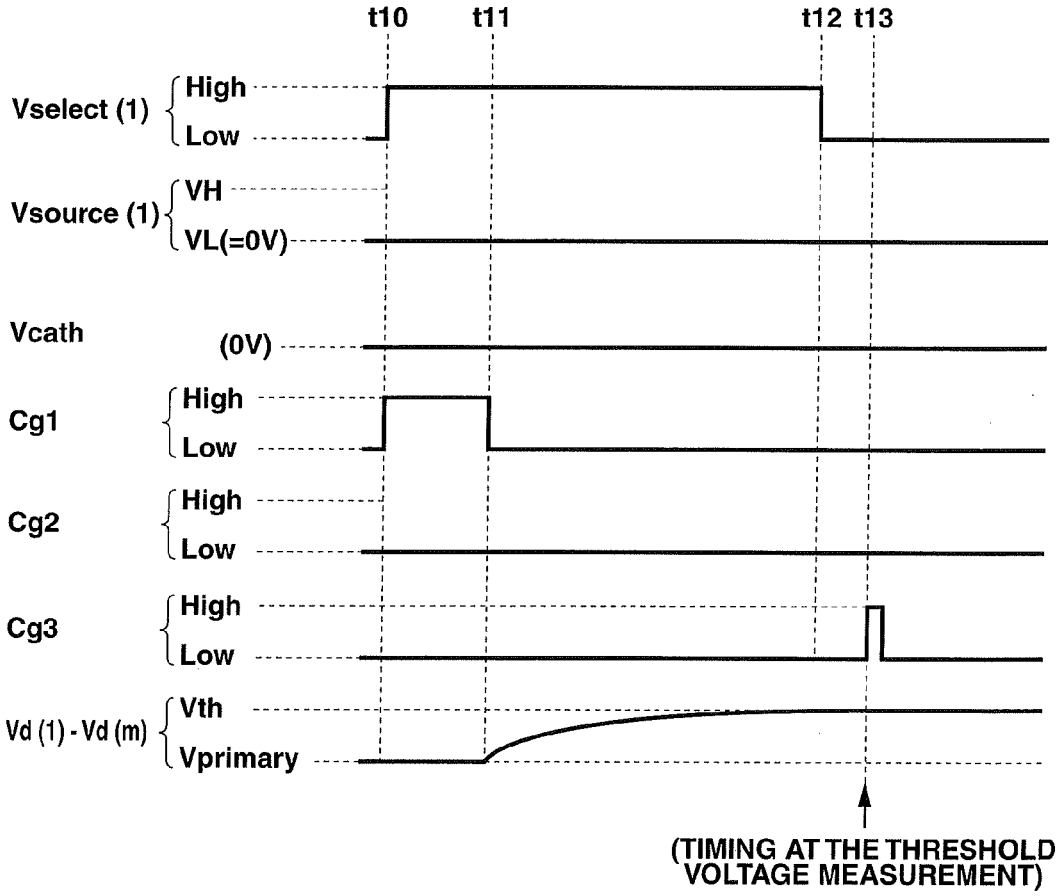
FIG. 8 is a timing chart showing an operation when a threshold voltage of the drive transistor using the auto-zero method is acquired.

As shown in FIG. 8, when the select driver 14 outputs the high-level signal Vselect(1) to the select line Ls(1) at time t10, the transistors T1 and T2 in the pixel circuits 11(1, 1) through 11(m, 1) are turned on. Consequently, the transistor T3 is also turned on.

The period being output from the high-level signal Vselect (1) to the select line Ls(1) by the select driver 14 becomes the period of first-line selection.

The power-supply driver 15 applies the voltage signal Vsource(1) of the voltage VL to the voltage line Lv(j).

At this time, the voltage of the voltage line Lv(1) is set to 0 V even if each transistor T3 in the pixel circuits 11(1, 1) through 11(m, 1) is turned on; however, the current does not flow into the OLED 111 because the cathode voltage in the OLED 111 is 0 V.

Figures 9A, 9B, 9C:
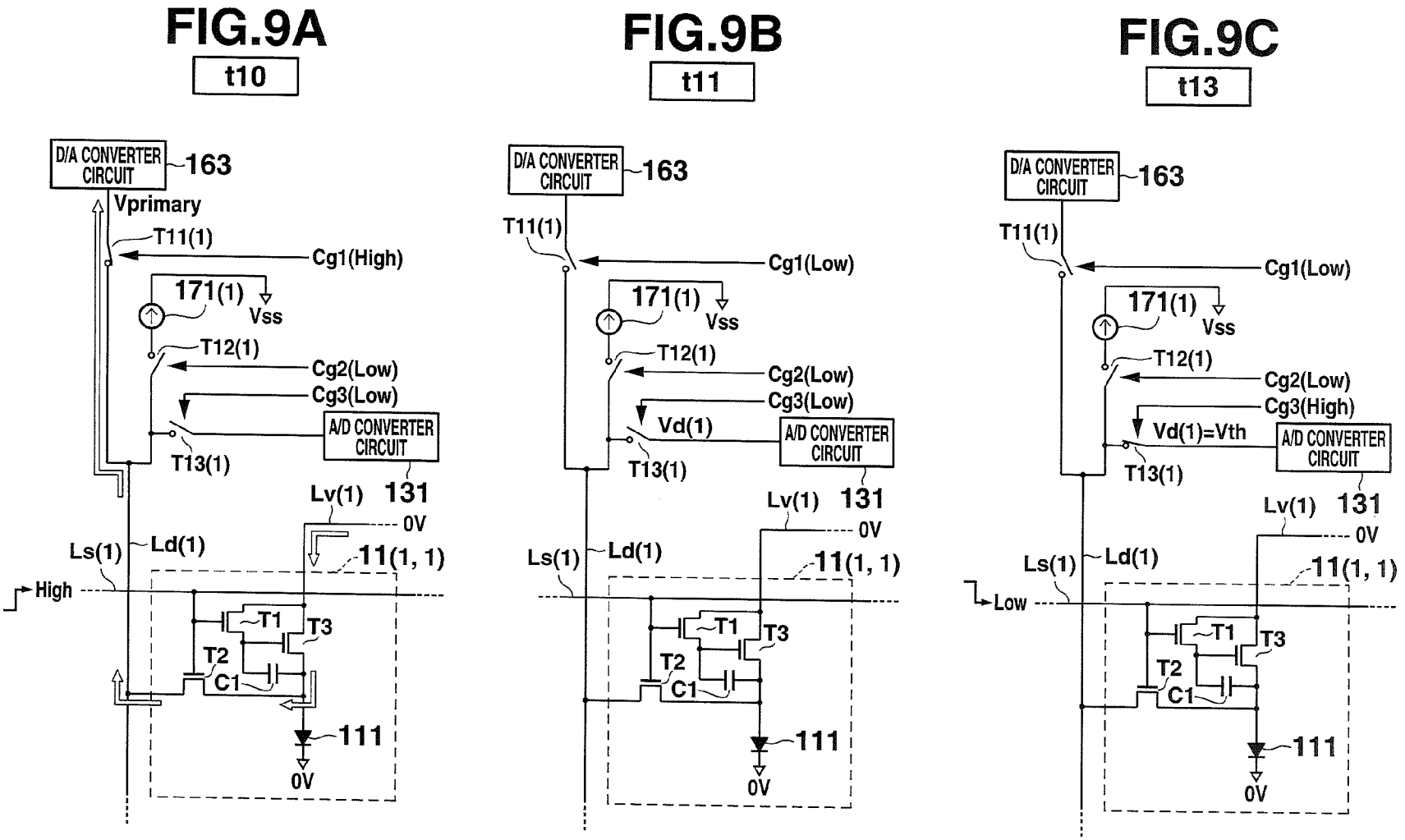
FIGS. 9A, 9B and 9C are diagrams showing an operation when the threshold voltage of the drive transistor using the auto-zero method is acquired.

As shown in FIG. 9A, the controller 13 outputs the control signals Cg1(High), Cg2(Low) and Cg3(Low) to the characteristics-acquiring switching circuit 17.

The transistors T11(1) through T11(m) in the characteristics-acquiring switching circuit 17 are turned on after the control signal Cg1(High) is supplied to the gates. Consequently, the D/A converter circuit 163 and the data lines Ld(1) through Ld(m) are connected.

The transistors T12(1) through T12(m) are turned off after the control signal Cg2(Low) is supplied to the gates, whereupon the transistors T12(1) through T12(m) disconnect between the current sources 171(1) through 171(m) and the data lines Ld(1) through Ld(m), respectively.

The transistors T13(1) through T13(m) are turned off after the control signal Cg3(Low) is supplied to the gates. Consequently, the transistors T13(1) through T13(m) disconnect between the current downstream terminals of the current sources 171(1) through 171(m) and the A/D converter circuit 131 in the controller 13.

The D/A converter circuit 163 outputs the voltage signal of the initial voltage Vprimary to the characteristics-acquiring switching circuit 17. As a result, the initial voltage Vprimary is applied to the data line Ld(1).

As shown in FIG. 9A, when the initial voltage Vprimary is applied to the data line Ld(1), the current flows from the voltage line Lv(1) to the D/A converter circuit 163 via the drain source in the transistor T3, the drain source in the transistor T2, the data line Ld(1) and the transistor T11(1), as indicated by an arrow in FIG. 9A.

The capacitor C1 in the pixel circuit 11(1, 1) is charged using this initial voltage Vprimary. Similarly, each capacitor C1 in pixel circuits 11(2, 1) through 11(m, 1) is charged using this initial voltage Vprimary.

When the current is at time t11 after the capacitor C1 is charged with the initial voltage Vprimary, the controller 13 supplies the control signal Cg1(Low) to the characteristics-acquiring switching circuit 17, as shown in FIG. 9B.

The transistors T11(1) through T11(m) are turned off after the control signal Cg1(Low) is supplied to the gates. When the transistor T11(1) is turned off, the drain voltage Vds in the transistor T3 is naturally relaxed through the capacitor C1 and gradually degraded.

When time t12 arrives (once the relaxation time t is elapsed from time t11), the drain voltage Vds is degraded to the threshold voltage Vth and the drain current Id hardly flows into the transistor T3. As shown in FIG. 9C, the select driver 14 lowers the select signal Vselect(1) to the low-level state. Consequently, the period of first-line selection is terminated.

As shown in FIG. 8, the controller 13 supplies the control signal Cg3(High) to the characteristics-acquiring switching circuit 17 between time t13 and t14 after the period of first-line selection.

The transistors T13(1) through T13(m) in the characteristics-acquiring switching circuit 17 are turned on after the control signal Cg3(High) is supplied to the gates. Consequently, the data lines Ld(1) through Ld(m) are connected to the A/D converter circuit 131 in the controller 13.

The A/D converter circuit 131 is used to measure the voltages Vd(1) through Vd(m) of the data lines Ld(1) through Ld(m) in parallel, and to acquire the voltages Vd(1) through Vd(m) as the threshold voltage Vth of the transistor T3 in the pixel circuits 11(1, 1) through 11(m, 1).

The A/D converter circuit 131 stores the threshold voltage Vth in the transistor T3 for the pixel circuits 11(1, 1) through 11(m, 1) into the storage areas corresponding to the pixel circuits 11(1, 1) through 11(m, 1) in the correction data storage circuit 132.

Similarly, the A/D converter circuit 131 acquires the threshold voltage Vth in the transistor T3 for each pixel circuit 11(i, j) during each selection period used to select the second line, . . . , nth line pixel circuit 11(i, j) by the select driver 14. Also, the acquired threshold voltage Vth is stored in each storage area in the correction data storage circuit 132.

The following describes an operation used to acquire the β value: The display device 1 acquires the voltage Vsink in each pixel circuit 11(i, j) according to the current supply-voltage measurement method, and acquires the β value based on the acquired voltage Vsink.

Figure 10:
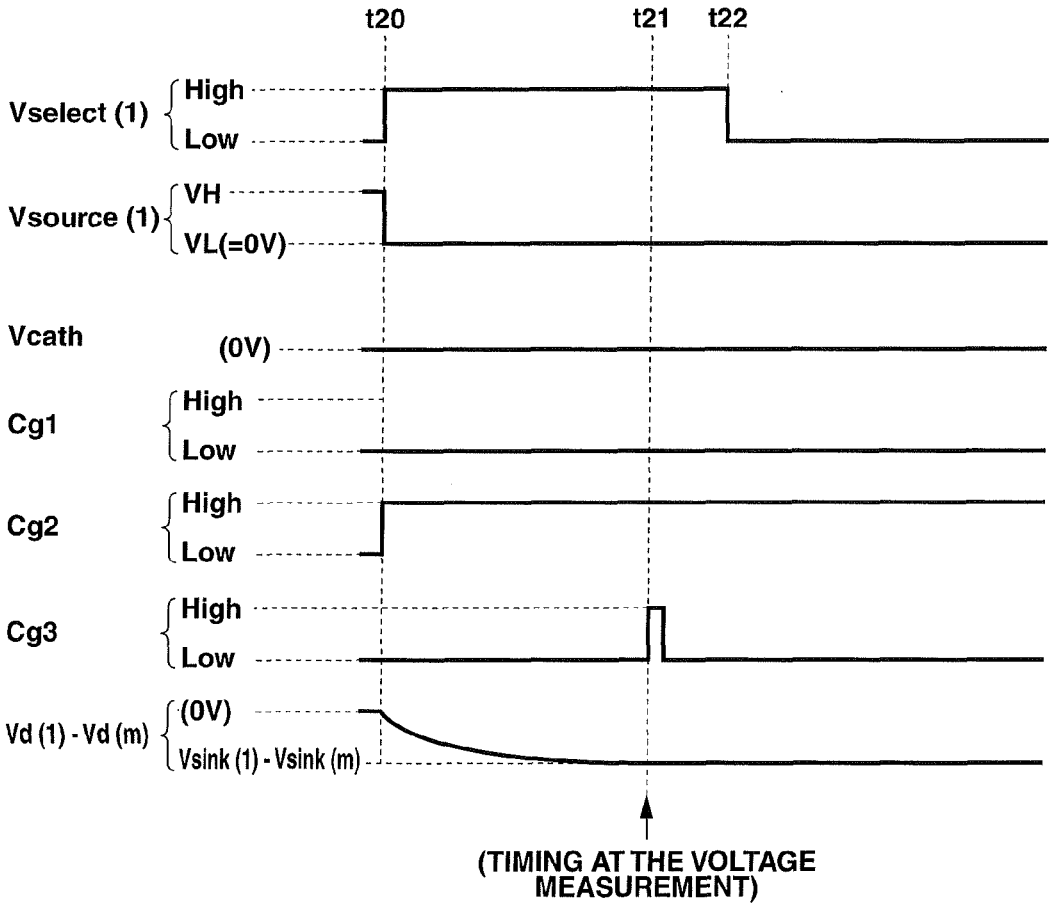
FIG. 10 is a timing chart showing an operation during a measurement of the voltage using the current supply-voltage measurement method.

As shown in FIG. 10, the select driver 14 outputs the high-level select signal Vselect(1) to the select line Ls(1) at time t20, while the power-supply driver 15 outputs the voltage signal Vsource(1) in the voltage VL to the voltage line Lv(1). Note that the transistors T11, T12 and T13 are indicated as switches in FIG. 11A,B.

When the high-level select signal Vselect(1) is output to the select line Ls(1), the transistors T1 and T2 in the pixel circuits 11(1, 1) through 11(m, 1) are turned on. As a result, the transistor T3 is also turned on.

At that time, the voltage of the voltage line Lv(1) is set to 0 V even if each transistor T3 in the pixel circuits 11(1, 1) through 11(m, 1) is turned on, and the current does not flow into the OLED 111 because the cathode voltage in the OLED 111 is 0 V.

Figure 11B:
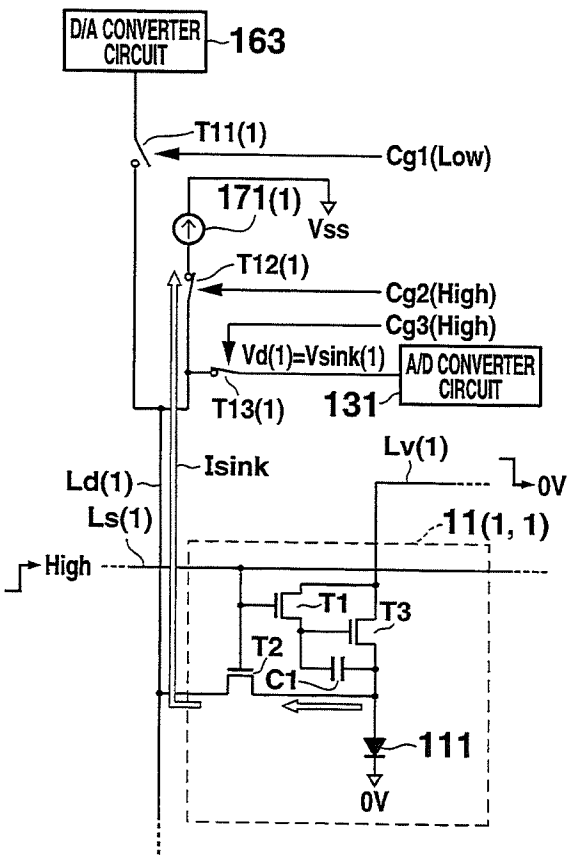
FIGS. 11A and 11B are diagrams describing an operation during a measurement of the voltage using the current supply-voltage measurement method.
Figure 11A:
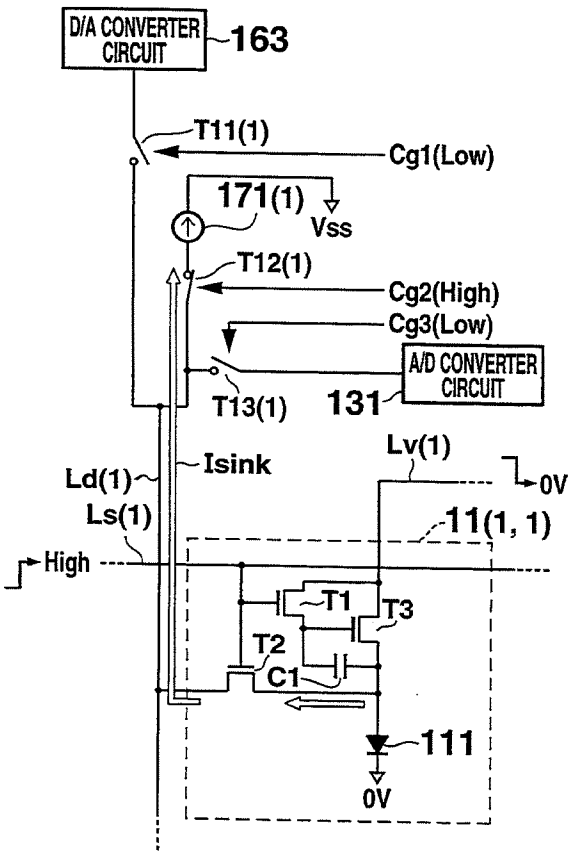

Subsequently, as shown in FIG. 11A, the controller 13 outputs the control signals Cg1(Low), Cg2(High) and Cg3 (Low) to the characteristics-acquiring switching circuit 17. The transistors T11(1) through T11(m) in the characteristics-acquiring switching circuit 17 are turned off after the control signal Cg1(Low) is supplied to the gates. Consequently, the D/A converter circuit 163 and the data lines Ld(1) through Ld(m) are disconnected.

The transistors T12(1) through T12(m) are turned on after the control signal Cg2(High) is supplied to the gates. As a result, the current sources 171(1) through 171(m) are connected to the data lines Ld(1) through Ld(m), respectively.

As shown in FIG. 11A, when the current source 171(1) and the data line Ld(1) are connected, the current Isink flows into the line of the voltage Vss via the drain source in the transistor T2, the data line Ld(1) and the current source 171(1), as indicated by an arrow in FIG. 11A.

When the current Isink flows in the drawing-in direction, the voltages Vd(1) through Vd(m) of the data lines Ld(1) through Ld(m) are degraded as shown in FIG. 10.

The controller 13 outputs the control signal Cg3(High) to the characteristics-acquiring switching circuit 17 at time t21, whereupon the voltages Vd(1) through Vd(m) become a constant voltage, as shown in FIG. 9A.

As shown in FIG. 11B, the transistors T13(1) through T13(m) are turned on after the control signal Cg3(High) is supplied to the gates. Consequently, the data lines Ld(1) through Ld(m) are connected to the A/D converter circuit 131.

The A/D converter circuit 131 measures the voltages Vd(1) through Vd(m) of the data lines Ld(1) through Ld(m), and acquires the measured voltages Vd(1) through Vd(m) as the voltages Vsink(1) through Vsink(m). The A/D converter circuit 131 then stores the acquired voltages Vsink in the storage areas that correspond to each pixel circuit 11(1, 1) through 11(m, 1) in the correction data storage circuit 132.

The select driver 14 lowers the select signal Vselect(1) to the low-level state at time t22 after acquiring the voltages Vsink(1) through Vsink(m) as shown in FIG. 10. Consequently, the period of first-line selection is terminated.

After time t22 is elapsed, the select driver 14 similarly selects the second-line pixel circuits 11(1, 2) through 11(m, 2), . . . , nth-line pixel circuits 11(1, n) through 11(m, n).

The A/D converter circuit 131 measures the voltage of the data lines Ld(1) through Ld(m) for each selection period, and the A/D converter circuit 131 then stores the measured voltages Vd(1) through Vd(m) into each storage area in the correction data storage circuit 132 as the voltages Vsink(1) through Vsink(m).

Subsequently, the correction processing circuit 133 in the controller 13 reads the threshold voltage Vth and the voltage Vsink for each line from the correction data storage circuit 132, and computes the β values for each pixel circuit 11(i, j) according to Formula 7.

The correction processing circuit 133 stores the β value for each pixel circuit 11(i, j) acquired by means of the computation in the correction data storage circuit 132.

The threshold voltage Vth and the β values are acquired from the above description. After the acquired threshold voltage Vth and the β values are stored in the correction data storage circuit 132, the video signal Image is supplied from the external source. The following describes an operation in which the OLED 111 in each pixel circuit 11(i, j) is in a light emitting operation.

When the video signal Image is supplied from the external source, the display signal generation circuit 12 acquires the image data Pic from the supplied video signal Image and the synchronous signal Sync, and supplies the image data Pic and the synchronous signal Sync to the controller 13. The controller 13 stores the supplied image data Pic into the correction data storage circuit 132.

Subsequently, the controller 13 executes the processing to write the voltage signals Sv(1) through Sv(m) to the capacitor C1 in each pixel circuit 11(i, j).

The controller 13 outputs the control signals Cg2(Low) and Cg3(Low) to the characteristics-acquiring switching circuit 17, and then outputs the start signals Sp1 and Sp2 to the select driver 14, the power-supply driver 15 and the data driver 16.

The select driver 14, the power-supply driver 15 and the data driver 16 start the operation after the start signals Sp1 and Sp2 are supplied from the controller 13, and operate according to the clock signals CLK1 and CLK2.

Figure 12:
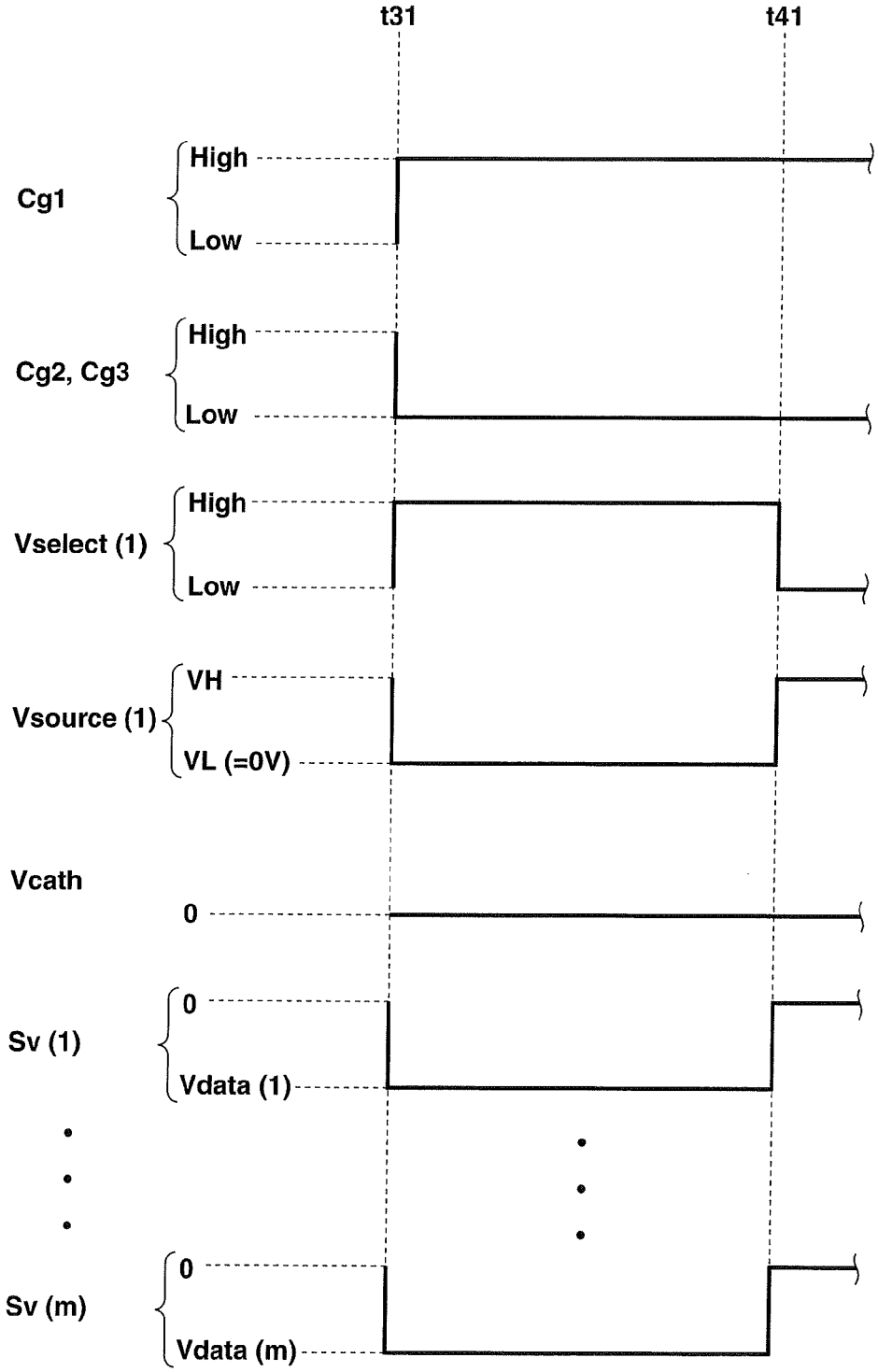
FIG. 12 is a timing chart showing an operation at a write processing.

After the select driver 14 starts the operation, and when the select driver 14 outputs the high-level signal Vselect(1) to the select line Ls(1) at time t31 as shown in FIG. 12, the transistors T1 and T2 in the pixel circuits 11(1, 1) through 11(m, 1) are turned on. Accordingly, the transistor T3 is also turned on.

At this time, the current does not flow into the OLED 111 even if the power-supply driver 15 outputs the signal Vsource (1) of voltage VL=0 V to the voltage line Lv(1) because the cathode voltage Vcath is 0 V.

The controller 13 outputs the control signal Cg1(High) to the characteristics-acquiring switching circuit 17. The transistors T11(1) through T11(m) are turned on after the control signal Cg1(High) is supplied to the gates. As a result, the D/A converter circuit 163 and the data lines Ld(1) through Ld(m) are connected.

The correction processing circuit 133 in the controller 13 reads the image data Pic from the correction data storage circuit 132, the threshold voltage Vth in the transistor T3 in each pixel circuit 11(i, j) and the β value for each line, and then corrects the voltage value Vcode corresponding to the gradation values of the image data Pic for each line according to Formula 5, whereupon the correction processing circuit 133 acquires the correction gradation signals Sdata(1) through Sdata(m).

The controller 13 outputs the correction gradation signals Sdata(1) through Sdata(m) acquired by the correction processing circuit 133 to the data driver 16.

The shift register/data register circuit 161 in the data driver 16 reads the digital correction gradation signals Sdata(1) through Sdata(m) supplied from the controller 13 by shifting one by one, and supplies the digital correction gradation signals Sdata(1) through Sdata(m) to the data latch circuit 162.

The data latch circuit 162 retains the correction gradation signals Sdata(1) through Sdata(m) supplied from the shift register/data register circuit 161, and supplies the correction gradation signals Sdata(1) through Sdata(m) to the D/A converter circuit 163. The D/A converter circuit 163 generates the voltage signals Sv(1) through Sv(m) that have the negative polarity gradation voltages Vdata(1) through Vdata(m) which are converted from the digital correction gradation signals Sdata(1) through Sdata(m) retained by the data latch circuit 162 into analog values.

The D/A converter circuit 163 supplies the generated voltage signals Sv(1) through Sv(m) to the characteristics-acquiring switching circuit 17. Since the D/A converter circuit 163 and the data lines Ld(1) through Ld(m) are connected via the transistors T11(1) through T11(m) respectively, the voltage signals Sv(1) through Sv(m) are output to the data lines Ld(1) through Ld(m), respectively.

When the negative polarity voltage signals Sv(1) through Sv(m) are output to the data lines Ld(1) through Ld(m), the current flows from the power-supply driver 15 to the D/A converter circuit 163 via the pixel circuits 11(1, 1) through 11(m, 1) and the transistors T11(1) through T11(m).

As a result, each capacitor C1 in the pixel circuits 11(1, 1) through 11(m, 1) is charged with the gradation voltages Vdata (1) through Vdata(m) of the voltage signals Sv(1) through Sv(m).

The select driver 14 lowers the signal Vselect(1) to the low-level state at time t41. When the signal Vselect(1) is set to the low-level state, the transistors T1 and T2 in the pixel circuits 11(1, 1) through 11(m, 1) are turned off.

Each capacitor C1 in the pixel circuits 11(1, 1) through 11(m, 1) retains the voltage of the charged voltage signals Sv(1) through Sv(m), respectively.

As for the second line pixel circuits 11(1, 2) through 11(m, 2), . . . , nth line pixel circuits 11(1, n) through 11(m, n), the controller 13 executes the write processing similar to the one used for the first line. Each capacitor C1 retains the voltages of the charged voltage signals Sv(1) through Sv(m).

Figure 13:
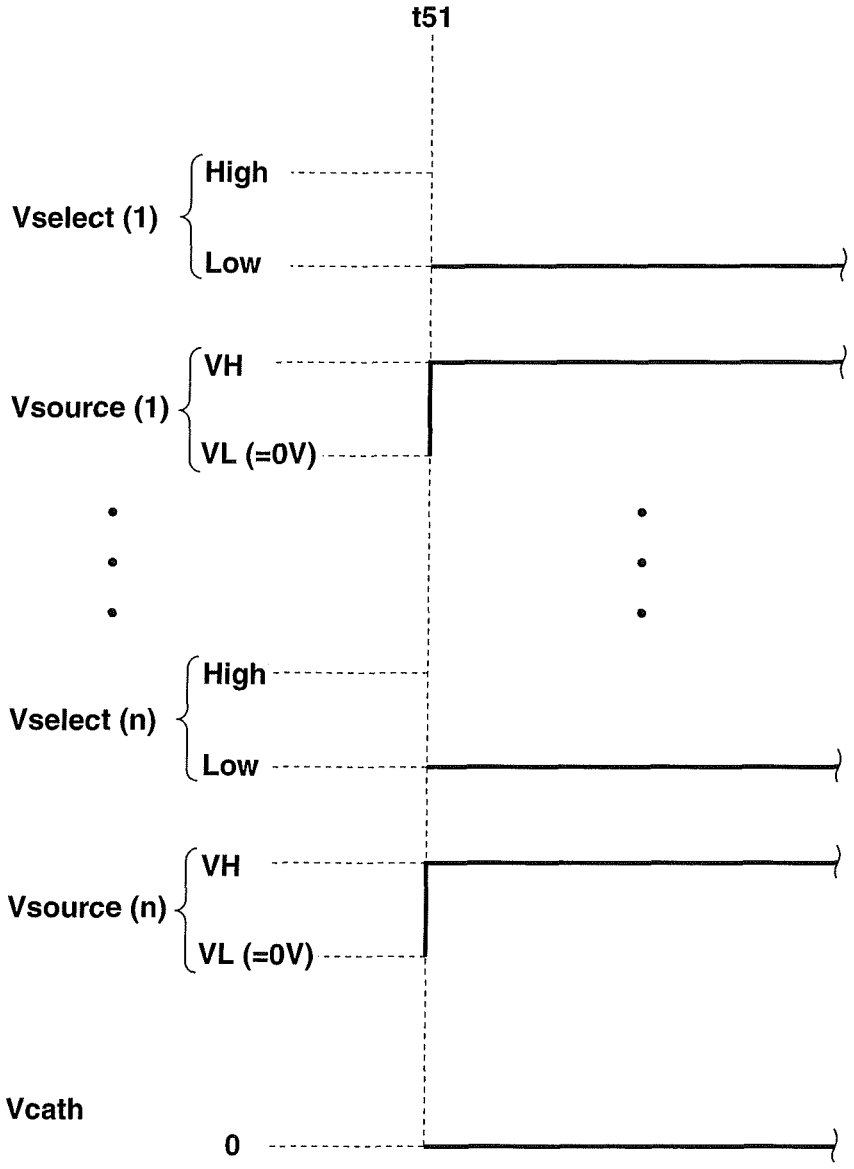
FIG. 13 is a timing chart showing an operation at light emission.

Once the write processing is complete, the controller 13 controls the light emitting operation. As shown in FIG. 13, the select driver 14 outputs the low-level signals Vselect(1) through Vselect(n) to the select lines Ls(1) through Ls(n) at time t51, respectively.

When the signal level of the select lines Ls(1) through Ls(n) becomes the low-level state, the transistors T1 and T2 in all pixel circuits 11(i, j) are turned off, and the transistor T3 enters to the flowing state.

The power-supply driver 15 outputs the signals Vsource(1) through Vsource(n) of the voltage VH (=+15 V) to the voltage lines Lv(1) through Lv(n).

When the voltage of the voltage lines Lv(1) through Lv(n) is set to the voltage VH, as in setting the voltage retained by each capacitor C1 to the gate voltage Vgs, the transistor T3 in each pixel circuit 11(i, j) supplies the drain current Id (which corresponds to the gate voltage Vgs) to the OLED 111.

When this drain current Id flows, each OLED 111 emits with the luminance corresponding to the current values.

As described above, according to this embodiment, the threshold voltage Vth of the transistor T3 in each pixel circuit 11(i, j) is acquired using the auto-zero method. Furthermore, the current Isink is supplied using the current supply-voltage measurement method in order to acquire the voltage Vsink and the β value.

Therefore, the threshold voltage Vth and the β value of the transistor T3 in each pixel circuit 11(i, j) can be acquired without complicated calculation. Because the image data Pc is corrected based on the β value in addition to the threshold voltage Vth, the over-time change of the transistor T3 as well as any variations in manufacturing processes can be corrected in order to control the degradation of image quality.

Furthermore, the controller 13 can be used to measure the threshold voltage Vth in the transistor T3 for each pixel circuit 11(i, j) simply by installing the A/D converter circuit 131, and also to measure the voltage Vsink, which simplifies the circuits and makes computation processing easier.

Note that this invention is not limited to the application described above, but also allows various other applications.

In this embodiment, for example, the display device 1 is used to describe the current supply-voltage measurement method for acquiring the voltage-current characteristics of the transistor T3 in each pixel circuit 11(i, j). However, the voltage-current characteristics of the transistor T3 in each pixel circuit 11(i, j) may also be acquired using the voltage-applied current measurement method.

Figure 14:
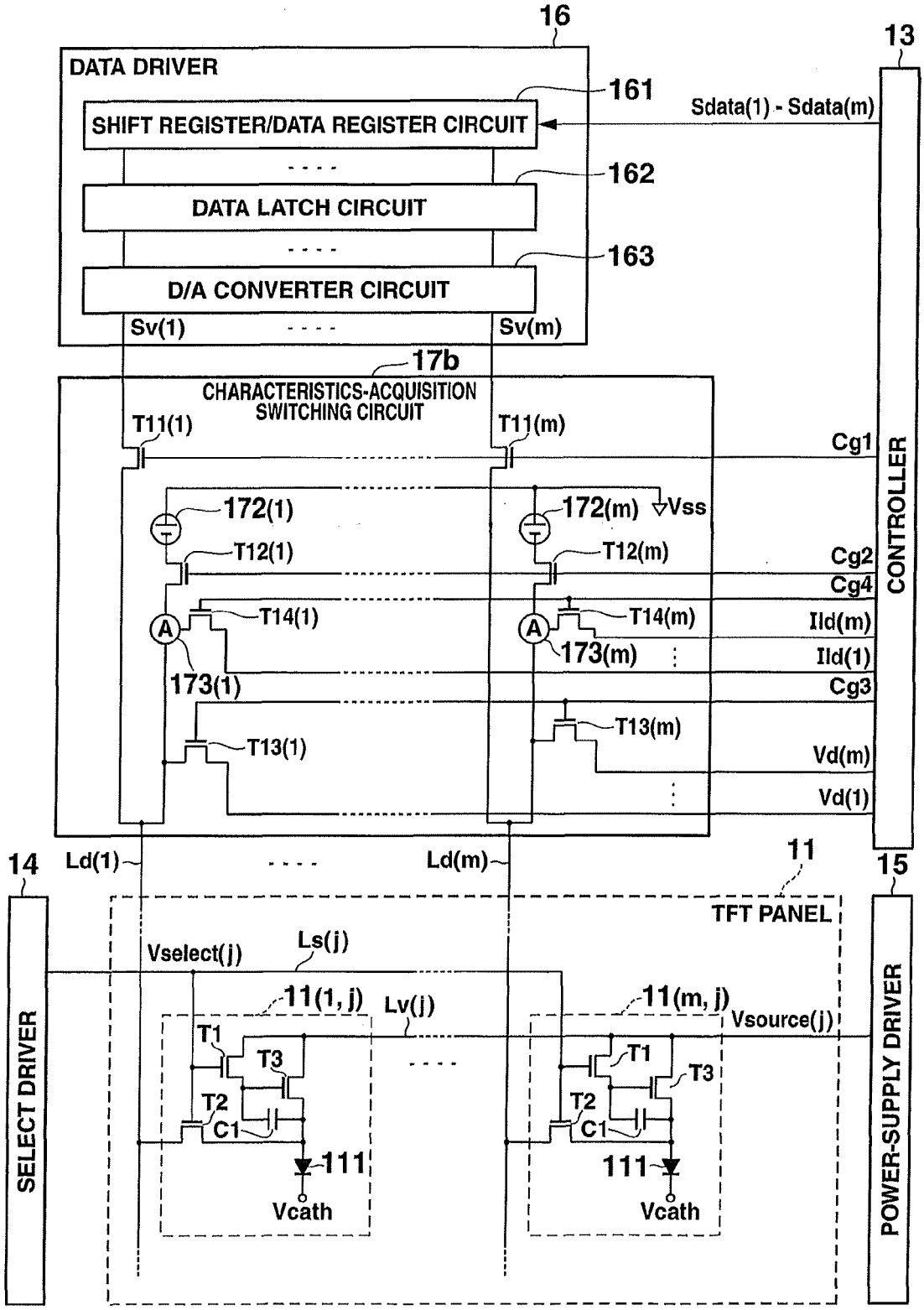
FIG. 14 is a diagram showing a structure of the characteristics-acquiring switching circuit.

In this case, as shown in FIG. 14, the characteristics-acquiring switching circuit 17*b* includes the power-supply sources 172(1) through 172(m) that supply the voltage for measurement; the transistors T11(1) through T11(m), T12(1) through T12(m), T13(1) through T13(m), T14(1) through T14(m); and the ammeters 173(1) through 173(m) installed between the transistors T12(1) through T12(m) and each data line Ld(1) through Ld(m). The transistors T14(1) through T14(m) are installed between the ammeters 173(1) through 173(m) and the A/D converter circuit 131 in the controller 13. The voltage supplied by the power-supply sources 172(1) through 172(m) has negative polarity. The voltage values of the voltage to be supplied by the power-supply sources 172(1) through 172(m) are set in advance, or they are set by the controller 13. When the transistors T11(1) through T11(m) are turned on, the D/A converter circuit 163 in the data driver 16 is connected to the data lines Ld(1) through Ld(m).

Figure 15B:
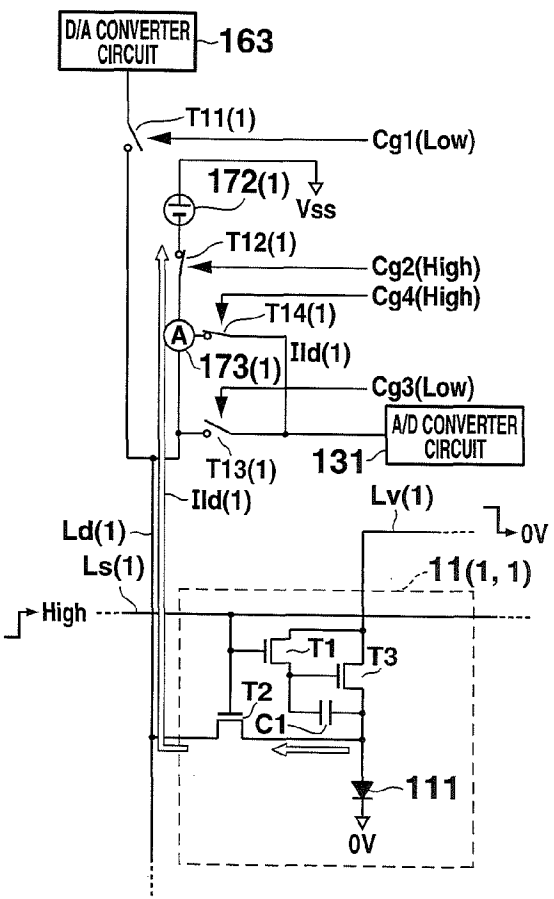
FIGS. 15A and 15B are diagrams describing an operation during the voltage measurement using the current supply-voltage measurement method.
Figure 15A:
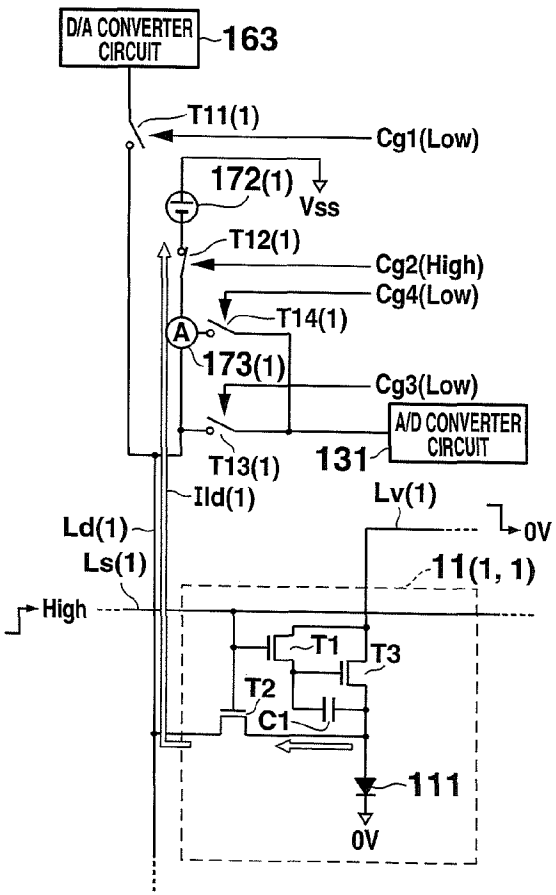

While the high-level select signal Vselect(1) is output to the select line Ls(1), as shown in FIG. 15A, the transistors T11(1) through T11(m), T13(1) through T13(m) and T14(1) through T14(m) are turned off at time t20*b*, however the transistors T12(1) through T12(m) are turned on. The power-supply sources 172(1) through 172(m) are connected to the data lines Ld(1) through Ld(m) via the ammeters 173(1) through 173(m). As a result, the current Ild(1) through Ild(m) flows into each data line Ld(1) through Ld(m) via the transistors T12(1) through T12(m) corresponding to the voltage supplied by the power-supply sources 172(1) through 172 (m). As for the pixel circuit 11(1,1), this current flows into the power-supply source 172(1) side via the drain source in the transistor T3, data line Ld(1) and the ammeter 173(1) from the drain source in the transistor T3. Then, as shown in FIG. 15B, when the transistors T13(1) through T13(m) are turned on at time t21*b* when the current values of this current Ild(1) through Ild(m) are made constant, the values (voltage values) corresponding to the current values in the current Ild(1) through Ild(m) acquired from the ammeters 173(1) through 173(m) are supplied to the A/D converter circuit 131 in the controller 13 via the transistors T14(1) through T14(m).

Note that the voltage preset according to the voltage values may be applied to each data line Ld(1) through Ld(m) from the D/A converter circuit 163 instead of providing the voltage sources to the characteristics-acquiring switching circuit 17.

In the above embodiment, the characteristics-acquiring switching circuit 17 is described as a configuration installed separately from the data driver 16. However, the data driver 16 may have the characteristics-acquiring switching circuit 17 built-in.

In the above embodiment, the controller 13 includes two or more A/D converter circuits 131. However, the data driver 16 may include two or more A/D converter circuits 131, and each A/D converter circuit 131 may be connected to the source in the transistor T13.

In the above embodiment, the same number of A/D converter circuits 131 as the line number of the OEL panel 11 is installed in order to perform the measurement for the voltage Vd in parallel. However, for example, a smaller number of A/D converter circuits 131 than the line number of the OEL panel 11 may be installed, in which case the connection between each data line and each A/D converter circuit 131 is switched one by one to perform the measurement for the voltage Vd. Furthermore, it is possible to install only one A/D converter circuit 131, in which case the connection may be switched one by one for every data line in order to perform the measurement for the voltage Vd. Thus, the time required for the voltage Vd measurement for all data lines is increased in comparison to a case in which two or more A/D converter circuits are installed. Nevertheless, the circuit scale can be reduced.

In the above embodiment, there are three transistors used in as a configuration of the pixel circuit 11(i, j). However, the pixel circuit 11(i, j) is not limited to this configuration. For instance, a pixel circuit may have a configuration of two transistors or more than three transistors.

Moreover, this invention is described for a case that is applicable to the display device 1 including the OEL panel 11, but it is not limited to such an application.

For example, this invention may be applied to an exposure device which includes multiple pixels having the light emitting elements by means of the OLED 111 and including the light emitting element array arranged in one direction, and which is used to irradiate and expose the light emitted from the light emitting element array to the photoreceptor drum according to the image data. In this case, the degradation of exposure conditions caused by degradation over time, or due to variations in characteristics, can be controlled.

Having described and illustrated the principles of this application by reference to one or more preferred embodiments, it should be apparent that the preferred embodiment(s) may be modified in arrangement and detail without departing from the principles disclosed herein and that it is intended that the application be construed as including all such modifications and variations insofar as they come within the spirit and scope of the subject matter disclosed herein.

What is claimed is:

1. A pixel driving device for driving pixels in accordance with image data, wherein each of the pixels includes a light emitting element, a driving element and a capacitor, wherein the driving element has a control terminal and one end of a current path connected to one terminal of the light emitting element and electrically connected to a signal line, and the capacitor is connected between the control terminal of the driving element and the one end of the current path of the driving element, the pixel driving device comprising:

a first measuring circuit which acquires a threshold voltage of the driving element based on a first voltage value at a terminal of the signal line, wherein the first voltage value is acquired after an initial voltage having a second voltage value that exceeds the threshold voltage of the driving element is applied to the terminal of the signal line and a predetermined relaxation time has elapsed after application of the initial voltage to the signal line is cut off;

a second measuring circuit which acquires voltage-current characteristics of the driving element and which acquires a current gain value of the driving element based on the acquired voltage-current characteristics of the driving element and the threshold voltage of the driving element acquired by the first measuring circuit; and a correction processing circuit which generates a correction gradation signal by correcting the image data to be supplied from an external source based on the threshold voltage and the current gain value of the driving element acquired by the first measuring circuit and the second measuring circuit, wherein the correction processing circuit sets the correction gradation signal to have a gradation voltage Vdata represented by Formula 1:

$$Vdata = Vcode \times \sqrt{\frac{\beta m}{\beta}} + Vth \tag{1}$$

where Vcode is a voltage value corresponding to a gradation value of the image data, β is the acquired current gain value of the driving element, βm is a predetermined proportional coefficient, and Vth is the acquired threshold voltage of the driving element.

2. The pixel driving device according to claim 1, wherein:

the first measuring circuit includes: (i) a voltage applying circuit which outputs the initial voltage, (ii) a voltage acquisition circuit which acquires the first voltage value at the terminal of the signal line, and (iii) a switching circuit which switches connections among the terminal of the signal line, the voltage applying circuit and the voltage acquisition circuit;

the switching circuit connects the terminal of the signal line and the voltage applying circuit, disconnects the connection between the terminal of the signal line and the voltage applying circuit after the initial voltage is applied to the terminal of the signal line by the voltage applying circuit, and connects the terminal of the signal line and the voltage acquisition circuit after the relaxation time has elapsed; and the first measuring circuit acquires the first voltage value acquired by the voltage acquisition circuit at the terminal of the signal line as the threshold voltage of the driving element.

3. The pixel driving device according to claim 2, wherein the relaxation time is set to a time needed for convergence to a constant charge storage capacity by partial discharge of a charge, after the initial voltage is applied to the driving element and a charge corresponding to the initial voltage is accumulated in the capacitor, and the connection between the voltage applying circuit and the signal line is disconnected.

4. The pixel driving device according to claim 1, wherein:

the second measuring circuit includes: (i) a current source which supplies a current for measurement, (ii) a voltage acquisition circuit which acquires a third voltage value at the terminal of the signal line, and (iii) a switching circuit which switches connections among the terminal of the signal line, the current source and the voltage acquisition circuit;

the switching circuit connects the terminal of the signal line, the current source and the voltage acquisition circuit in order to acquire the voltage-current characteristics of the driving element; and the second measuring circuit acquires the voltage-current characteristics of the driving element based on the third voltage value acquired by the voltage acquisition circuit at the terminal of the signal line when the current for measurement is supplied from the current source, and based on a current value of the current for measurement.

5. The pixel driving device according to claim 1, wherein:

the second measuring circuit includes: (i) a voltage source which supplies a voltage for measurement, (ii) an ammeter which measures a current value of a current which flows into the signal line, and (iii) a switching circuit which switches a connection between the terminal of the signal line and the voltage source;

the switching circuit connects the terminal of the signal line and the voltage source in order to acquire the voltage-current characteristics of the driving element; and the second measuring circuit acquires the voltage-current characteristics of the driving element based on the current value of the current measured by the ammeter when the voltage for measurement is supplied from the voltage source, and based on a voltage value of the voltage for measurement.

6. The pixel driving device according to claim 1, further comprising:

a storage circuit which stores the acquired threshold voltage and the current gain value of the driving element, wherein the correction processing circuit corrects the image data based on the threshold voltage and the current gain value stored in the storage circuit.

7. A light emitting device for emitting light in accordance with image data, comprising:

a pixel array including a plurality of pixels and a plurality of signal lines, wherein each of the pixels includes a light-emitting element, a driving element and a capacitor, wherein the driving element has one end of a current path connected to one terminal of the light-emitting element, and electrically connected to a corresponding signal line, and the capacitor is connected between a control terminal of the driving element and the one end of the current path of the driving element;

a plurality of first measuring circuits which acquire threshold voltages of the driving elements of the plurality of pixels based on first voltage values at terminals of the plurality of signal lines, wherein the first voltage values are acquired after an initial voltage having a second voltage value that exceeds the threshold voltages of the driving elements is applied to the terminals of the plurality of signal lines and a predetermined relaxation time has elapsed after application of the initial voltage to the plurality of signal lines is cut off;

a plurality of second measuring circuits which acquire voltage-current characteristics of the driving elements of the plurality of pixels and which acquire current gain values of the driving elements of the plurality of pixels based on the acquired voltage-current characteristics and the threshold voltages of the driving elements of the plurality of pixels acquired by the plurality of first measuring circuits; and a correction processing circuit which generates correction gradation signals of the plurality of pixels by correcting the image data to be supplied from an external source based on the threshold voltages and the current gain values of the driving elements of the plurality of pixels acquired by the plurality of first measuring circuits and the plurality of second measuring circuits, wherein the correction processing circuit sets the correction gradation signal of each pixel to have a gradation voltage Vdata represented by Formula 1:

$$Vdata = Vcode \times \sqrt{\frac{\beta m}{\beta}} + Vth \quad (1)$$

where Vcode is a voltage value corresponding to a gradation value of the image data of the pixel, β is the acquired current gain value of the driving element of the pixel, βm is a predetermined proportional coefficient, and Vth is the acquired threshold voltage of the driving element of the pixel.

8. The light emitting device according to claim 7, further comprising a select driver, wherein:

the plurality of signal lines are arranged along a first direction, the pixel array includes at least one scanning line which is arranged along a second direction that crosses the first direction, and the plurality of pixels are placed near each intersection of the at least one scanning line and the plurality of signal lines;

the select driver sets the plurality of pixels which are connected to the scanning line to a select state by applying a select signal to the scanning line; and the plurality of first measuring circuits and the plurality of second measuring circuits acquire the threshold voltages and the current gain values of the driving elements of the plurality of pixels which are set to the select state.

9. The light emitting device according to claim 8, wherein each pixel includes a pixel driving circuit comprising:

a first thin-film transistor having a first terminal and a second terminal of a current path and a control terminal, wherein the first terminal is connected to a connection point of the one terminal of the light emitting element, and a predetermined power-supply voltage is applied to the second terminal;

a second thin-film transistor having a first terminal and a second terminal of a current path and a control terminal, wherein the control terminal is connected to the at least one scanning line, the first terminal is connected to the second terminal of the first thin-film transistor, and the second terminal is connected to the control terminal of the first thin-film transistor; and a third thin-film transistor having a first terminal and a second terminal of a current path and a control terminal, wherein the control terminal is connected to the scanning line, the first terminal is connected to one of the plurality of signal lines, and the second terminal is connected to the connection point, wherein the first thin-film transistor corresponds to the driving element, and when the pixel is set to the select state by the select driver, the second thin-film transistor and the third thin-film transistor are set to an on state, the second terminal of the first thin-film transistor and the control terminal of the first thin-film transistor are connected, and the one of the plurality of signal lines and the connection point are connected via the current path of the third thin-film transistor.

10. The light emitting device according to claim 7, wherein:

each of the first measuring circuits includes: (i) a voltage applying circuit which outputs the initial voltage, (ii) a voltage acquisition circuit which acquires the first voltage value at the terminal of a corresponding one of the signal lines, and (iii) a switching circuit which switches the connections among the terminal of the corresponding signal line, the voltage applying circuit and the voltage acquisition circuit;

the switching circuit connects the terminal of the corresponding signal line and the voltage applying circuit, disconnects the connection between the terminal of the corresponding signal line and the voltage applying circuit after the initial voltage is applied to the terminal of the signal line by the voltage applying circuit, and connects the terminal of the corresponding signal line and the voltage acquisition circuit after the relaxation time has elapsed; and the plurality of first measuring circuits acquire the first voltage values acquired by the voltage acquisition circuits at the terminals of the plurality of signal lines as the threshold voltages of the driving elements of the plurality of pixels.

11. The light emitting device according to claim 10, wherein the relaxation time is set to a time needed for convergence to a constant charge storage capacity by partial discharge of a charge, after the initial voltage is applied to the driving elements and charges corresponding to the initial voltage are accumulated in the capacitors, and connections between the voltage applying circuits and the signal lines are disconnected.

12. The light emitting device according to claim 7, wherein:

each of the second measuring circuit includes circuits includes: (i) a current source which supplies a current for measurement, (ii) a voltage acquisition circuit which acquires a third voltage value at the terminal of a corresponding signal line, and (iii) a switching circuit which switches the connections among the terminal of the corresponding signal line, the current source and the voltage acquisition circuit;

the switching circuit connects the terminal of the corresponding signal line, the current source and the voltage acquisition circuit in order to acquire the voltage-current characteristics of the driving element; and the plurality of second measuring circuits acquire the voltage-current characteristics of the driving elements based on the third voltage values acquired by the voltage acquisition circuits at the terminals of the signal lines when the current for measurement is supplied from the current sources, and based on a current value of the current for measurement.

13. The light emitting device according to claim 7, wherein:

each of the second measuring circuits includes: (i) a voltage source which supplies a voltage for measurement, (ii) an ammeter which measures a current value of current which flows into a corresponding signal line, and (iii) a switching circuit which switches the connections among the terminal of the corresponding signal line and the voltage source;

the switching circuit connects the terminal of the corresponding signal line and the voltage source in order to acquire the voltage-current characteristics of the driving element; and the plurality of second measuring circuits acquire the voltage-current characteristics of the driving elements based on the current values of the current measured by the ammeters when the voltage for measurement is supplied from the voltage sources, and based on a voltage value of the voltage for measurement.

14. The light emitting device according to claim 7, further comprising:

a storage circuit which stores the acquired threshold voltage and the current gain value of the driving element of each pixel; and wherein the correction processing circuit corrects the image data based on the threshold voltages and the current gain values stored in the storage circuit.

15. The light emitting device according to claim 7, wherein the light emitting element is an organic electroluminescence element.

16. A light emitting device driving control method of a light emitting device for emitting light in accordance with image data, wherein the light emitting device includes a pixel array having a plurality of pixels and a plurality of signal lines, wherein each of the pixels includes a light-emitting element, a driving element and a capacitor, wherein the driving element has one end of a current path connected to one terminal of the light-emitting element, and electrically connected to a corresponding signal line, and the capacitor is connected between a control terminal of the driving element and the one end of the current path of the driving element, the light emitting device driving control method comprising:

an initial voltage applying step of applying an initial voltage having a second voltage value that exceeds threshold voltages of the driving elements, to terminals of the plurality of signal lines;

a voltage acquiring step of acquiring first voltage values at the terminals of the plurality of signal lines when a predetermined relaxation time has elapsed after the application of the initial voltage to the plurality of signal lines is cut off;

a threshold voltage acquiring step of acquiring the threshold voltages of the driving elements of the plurality of pixels based on the acquired first voltage values;

a voltage-current characteristics acquiring step of acquiring voltage-current characteristics of the driving elements of the plurality of pixels;

a current gain acquiring step of acquiring current gain values of the driving elements of the plurality of pixels based on the acquired voltage-current characteristics and the acquired threshold voltages of the driving elements; and a correction step of generating correction gradation signals of the plurality of pixels by correcting the image data to be supplied from an external source based on the acquired threshold voltages and the acquired current gain values of the driving elements of the plurality of pixels, wherein the correction step comprises setting the correction gradation signal of each pixel to have gradation voltage Vdata represented by Formula 1:

$$Vdata = Vcode \times \sqrt{\frac{\beta m}{\beta}} + Vth \tag{1}$$

where Vcode is a voltage value corresponding to a gradation value of the image data of the pixel, β is the acquired current gain value of the driving element of the pixel, βm is a predetermined proportional coefficient, and Vth is the acquired threshold voltage of the driving element of the pixel.

17. The light emitting device driving control method according to claim 16, wherein the plurality of signal lines are arranged along a first direction, the pixel array includes at least one scanning line which is arranged along a second direction that crosses the first direction, and the plurality of pixels are placed near each intersection of the scanning line and the plurality of signal lines, and wherein the light emitting device driving control method further comprises:

a selecting step of setting the plurality of pixels connected to the scanning line to a select state by applying a select signal to the scanning line, wherein the threshold voltages and the current gain values of the driving elements of the plurality of pixels which are set to the select state are acquired in the threshold voltage acquiring step and the current gain acquiring step.

18. The light emitting device driving control method according to claim 16, wherein the voltage-current characteristics acquiring step comprises:

a current source connecting step of connecting a plurality of current sources which supply a current for measurement to the terminals of the plurality of signal lines;

a voltage value acquiring step of acquiring third voltage values at the terminals of the plurality of signal lines when the current for measurement is supplied to the plurality of signal lines from the current sources after the current sources are connected to the terminals of the plurality of signal lines in the current source connecting step; and a characteristics acquiring step of acquiring the voltage-current characteristics of the driving elements of the plurality of pixels based on the third voltage values at the terminals of the plurality of signal lines acquired in the voltage value acquiring step, and based on a current value of the current for measurement.

19. The light emitting device driving control method according to claim 16, wherein the voltage-current characteristics acquiring step comprises:

a voltage source connecting step of connecting a plurality of voltage sources which supply a voltage for measurement to the terminals of the plurality of signal lines;

a current value acquiring step of acquiring current values of a current which flows into the plurality of signal lines when the voltage for measurement is supplied to the plurality of signal lines from the voltage sources after the voltage sources are connected to the terminals of the plurality of signal lines in the voltage source connecting step; and a characteristics acquiring step of acquiring the voltage-current characteristics of the driving elements based on the current values of the current which flows into the plurality of signal lines acquired in the current value acquiring step, and based on a voltage value of the voltage for measurement.

* * * * *

UNITED STATES PATENT AND TRADEMARK OFFICE

CERTIFICATE OF CORRECTION

PATENT NO. : 8,570,255 B2
APPLICATION NO. : 12/749975
DATED : October 29, 2013
INVENTOR(S) : Manabu Takei It is certified that error appears in the above-identified patent and that said Letters Patent is hereby corrected as shown below:

In the Claims

Column 22, Line 63 (Claim 12, Line 3):

after “measuring” delete --circuit includes--.

Signed and Sealed this
First Day of April, 2014

Michelle K. Lee

Michelle K. Lee
*Deputy Director of the United States Patent and Trademark Office*